US007169444B2

(12) United States Patent
Onishi et al.

(10) Patent No.: US 7,169,444 B2
(45) Date of Patent: Jan. 30, 2007

(54) METHOD FOR TREATING SURFACE OF INK JET RECORDING MEDIUM HAVING RECORDED IMAGE

(75) Inventors: Hiroyuki Onishi, Nagano (JP); Shinya Yamagata, Nagano (JP); Masahiro Hanmura, Nagano (JP); Masaya Shibatani, Nagano (JP); Fumie Uehara, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 225 days.

(21) Appl. No.: 10/009,884

(22) PCT Filed: Mar. 13, 2001

(86) PCT No.: PCT/JP01/01970

§ 371 (c)(1),
(2), (4) Date: Nov. 13, 2001

(87) PCT Pub. No.: WO01/68377

PCT Pub. Date: Sep. 20, 2001

(65) Prior Publication Data

US 2003/0005945 A1 Jan. 9, 2003

(30) Foreign Application Priority Data

| | | |
|---|---|---|
| Mar. 13, 2000 | (JP) | 2000-069248 |
| Mar. 17, 2000 | (JP) | 2000-077116 |
| Jul. 14, 2000 | (JP) | 2000-215172 |
| Jul. 14, 2000 | (JP) | 2000-215173 |
| Nov. 9, 2000 | (JP) | 2000-341788 |
| Jan. 31, 2001 | (JP) | 2001-024584 |

(51) Int. Cl.
*B05D 5/00* (2006.01)
*B05D 1/36* (2006.01)

(52) U.S. Cl. ..... 427/258; 427/288; 427/411; 347/105

(58) Field of Classification Search ..... 427/258, 427/261, 265, 288, 407.1, 411; 106/287.3; 347/1, 101, 105, 106; 162/135, 136
See application file for complete search history.

(56) References Cited

U.S. PATENT DOCUMENTS

| | | | | |
|---|---|---|---|---|
| 3,028,252 | A * | 4/1962 | Mones et al. | 428/203 |
| 3,782,945 | A * | 1/1974 | Shimamura et al. | 430/267 |
| 4,301,236 | A * | 11/1981 | Idota et al. | 430/393 |
| 4,741,969 | A | 5/1988 | Hayama et al. | |
| 5,480,768 | A * | 1/1996 | Ishida et al. | 430/399 |
| 5,543,171 | A * | 8/1996 | Shores | 427/177 |
| 6,130,024 | A | 10/2000 | Aylward et al. | |

FOREIGN PATENT DOCUMENTS

| | | | |
|---|---|---|---|
| EP | 0 406 761 | | 1/1991 |
| EP | 0406761 | | 1/1991 |
| EP | 0 703 087 | | 3/1996 |
| EP | 0703087 | | 3/1996 |
| EP | 0 995 609 | | 4/2000 |
| JP | 55-150396 | A | 11/1980 |
| JP | 56-077154 | A | 6/1981 |
| JP | 57-069054 | A | 4/1982 |
| JP | 57-109662 | | 7/1982 |
| JP | 58-128862 | A | 8/1983 |
| JP | 6147284 | | 3/1986 |
| JP | 61-249755 | | 11/1986 |
| JP | 62170382 | | 7/1987 |
| JP | 63199649 | | 8/1988 |
| JP | 1 291990 | | 11/1989 |
| JP | 02-080279 | A | 3/1990 |
| JP | 02-194958 | A | 8/1990 |
| JP | 03-240557 | A | 10/1991 |
| JP | 05-221115 | A | 8/1993 |
| JP | 05-318943 | A | 12/1993 |
| JP | 7 041 726 | | 2/1995 |
| JP | 07-041726 | A * | 2/1995 |
| JP | 741726 | | 2/1995 |
| JP | 07-246769 | A | 9/1995 |
| JP | 07-276789 | A | 10/1995 |
| JP | 7-96603 | | 11/1995 |
| JP | 08 072230 | | 3/1996 |
| JP | 08 104000 | | 4/1996 |
| JP | 08-164664 | A | 6/1996 |
| JP | 8 174989 | | 7/1996 |
| JP | 08-174989 | A | 7/1996 |
| JP | 08-174992 | A | 7/1996 |

(Continued)

OTHER PUBLICATIONS

Patent Abstracts of Japan including translation of the abstract, specification and claims Publication No. 11-279440 dated Oct. 12, 1999.

(Continued)

*Primary Examiner*—William Phillip Fletcher, III
(74) *Attorney, Agent, or Firm*—Ladas & Parry LLP

(57) ABSTRACT

[The present invention] provides a surface treatment method for recorded matter which can improve the weather resistance characteristics such as light resistance, gas resistance and the like of recorded matter in which images are recorded on the recording medium, as well as providing a surface-treated product using this surface treatment method, and a surface treatment apparatus. The surface treatment method of the present invention is characterized in that the surface of recorded matter in which images are recorded on a recording medium is treated using a specified treatment agent. The abovementioned treatment agent is a treatment agent which contains one or more active constituents selected from the group consisting of sulfur compounds, nitrogen compounds, fluorine compounds, natural resins and synthetic resins, or a treatment agent comprising water or an organic solvent.

8 Claims, 9 Drawing Sheets

FOREIGN PATENT DOCUMENTS

| | | | | |
|---|---|---|---|---|
| JP | 08-207429 | A | | 8/1996 |
| JP | 08 216392 | | | 8/1996 |
| JP | 08 216434 | | | 8/1996 |
| JP | 08-252883 | A | | 10/1996 |
| JP | 08-252985 | A | | 10/1996 |
| JP | 8-281933 | | | 10/1996 |
| JP | 09-048180 | A | * | 2/1997 |
| JP | 948180 | | | 2/1997 |
| JP | 09-111673 | | | 4/1997 |
| JP | 09-174995 | A | | 7/1997 |
| JP | 9-226154 | | | 9/1997 |
| JP | 09-254526 | A | | 9/1997 |
| JP | 9272199 | | | 10/1997 |
| JP | 09-292516 | | | 11/1997 |
| JP | 10-081064 | A | | 3/1998 |
| JP | 10-100397 | A | | 4/1998 |
| JP | 10-119420 | A | | 5/1998 |
| JP | 10-119423 | A | | 5/1998 |
| JP | 10-119424 | A | | 5/1998 |
| JP | 10-175365 | A | | 6/1998 |
| JP | 10-193776 | A | | 7/1998 |
| JP | 10-203006 | A | | 8/1998 |
| JP | 10291377 | | | 11/1998 |
| JP | 11-020300 | A | | 1/1999 |
| JP | 11-020306 | A | | 1/1999 |
| JP | 11-058942 | A | | 3/1999 |
| JP | 11-115308 | A | | 4/1999 |
| JP | 11-247076 | | | 9/1999 |
| JP | 11 263052 | | | 9/1999 |
| JP | 11263052 | | | 9/1999 |
| JP | 11-279440 | A | * | 10/1999 |
| JP | 11 279441 | | | 10/1999 |
| JP | 11277724 | | | 10/1999 |
| JP | 11277924 | | | 10/1999 |
| JP | 11279440 | | | 10/1999 |
| JP | 11279441 | | | 10/1999 |
| JP | 11291623 | | | 10/1999 |
| JP | 2000-177231 | | | 6/2000 |
| JP | 2000-335079 | | | 12/2000 |

OTHER PUBLICATIONS

Patent Abstracts of Japan including translation of the abstract, specification and claims Publication No. 11-277924 dated Oct. 12, 1999.

Patent Abstracts of Japan including translation of the abstract, specification and claims Publication No. 11-279441 dated Oct. 12, 1999.

Patent Abstracts of Japan including translation of the abstract, specification and claims Publication No. 10-291377 dated Nov. 4, 1998.

Patent Abstracts of Japan including translation of the abstract, specification and claims Publication No. 09-048180 dated Feg. 18, 1997.

Patent Abstracts of Japan including translation of the abstract, specification and claims Publication No. 07-041726 dated Feb. 10, 1995.

Patent Abstracts of Japan including translation of the abstract, specification and claims Publication No. 11-291623 dated Oct. 26, 1999.

Patent Abstracts of Japan Publication No. 62-170382 dated Jul. 27, 1987.

Patent Abstracts of Japan including translation of the abstract, specification and claims Publication No. 11-277724 dated Oct. 12, 1999.

Patent Abstracts of Japan including translation of the abstract, specification and claims Publication No. 11-263052 dated Sep. 28, 1999.

Patent Abstracts of Japan including translation of the abstract, specification and claims Publication No. 09-272199 dated Oct. 21, 1997.

Patent Abstracts of Japan Publication No. 63-199649 dated Aug. 18, 1988.

Patent Abstracts of Japan Publication No. 61-047284 dated Mar. 7, 1986.

Patent Abstracts of Japan of JP 1 291990 dated Nov. 24, 1989.

Patent Abstracts of Japan of JP 08-104000 dated Apr. 23, 1996.

Patent Abstracts of Japan of JP 08-072230 dated Mar. 19, 1996.

Patent Abstracts of Japan of JP 08-216434 dated Aug. 27, 1996.

Patent Abstracts of Japan of JP 08-216392 dated Aug. 27, 1996.

Patent Abstracts of Japan of JP 57-109662 dated Jul. 8, 1982.

JPO computer English translation and Patent Abstracts of Japan of JP 09-292516 dated Nov. 11, 1997.

JPO computer English translation and Patent Abstracts of Japan of JP 09-111673 dated Apr. 28, 1997.

JPO computer English translation and Patent Abstracts of Japan of JP 2000-335079 dated Dec. 5, 2000.

JPO computer English translation and Patent Abstracts of Japan of JP 2000-177231 dated Jun. 27, 2000.

JPO computer English translation and Patent Abstracts of Japan of JP 11-247076 dated Sep. 14, 1999.

Patent Abstracts of Japan of 61-249755 dated Nov. 6, 1986.

Patent Abstracts of Japan of 7-96603 dated Apr. 11, 1995.

Patent Abstracts of Japan of 8-281933 dated Oct. 29, 1996.

Patent Abstracts of Japan of 9-226154 dated Sep. 2, 1997.

* cited by examiner (a)

(b)

METHOD FOR TREATING SURFACE OF INK JET RECORDING MEDIUM HAVING RECORDED IMAGE

TECHNICAL FIELD

The present invention relates to a surface treatment method which can improve the storage characteristics over time (weather resistance characteristics such as light resistance, gas resistance and the like) of recorded materials in which images are recorded on a recording medium, a surface-treated products [that is treated] using this surface treatment method, and a surface treatment apparatus [using this surface treatment method].

BACKGROUND ART

As a result of revolutionary progress that has been made in ink jet recording technology in recent years, images output onto recording media by ink jet printing have shown improved high quality, so that the output of high-quality images comparable to silver halide photographs is now possible. However, the dye inks constituting the ink jet recording inks that are used for the output of high-quality images suffer from the following drawback: specifically, such inks tend to discolor or fade over time as a result of exposure to ultraviolet light, visible light, moisture, heat, nitrogen oxide gases, ozone gas and the like. Accordingly, printed matter recorded by ink jet recording using dye inks is inferior in terms of light resistance, water resistance and gas resistance, so that deterioration in recorded images such as discoloration and the like occurs in ordinary environments such as mounting on interior walls. Consequently, such printed matter still does not equal silver halide photographs in terms of storage characteristics (prevention of deterioration).

Furthermore, so-called absorption type media which have an ink receiving layer that contains a fine porous material such as amorphous silica or the like constitute the mainstream of ink jet recording media, and there has been a tendency for even finer materials to be used as such porous pigments in order to achieve a higher image quality. However, when such porous pigments are made even finer, the specific surface area is proportionally increased, so that the contact between the porous pigment in the ink receiving layer and the outside air increases; as a result, there is a danger that the storage characteristics of such printed matter, and especially the gas resistance, will deteriorate.

Furthermore, although ink jet recording materials themselves have reaches a fairly satisfactory standard in terms of water resistance in recent years, there are still problems regarding the light resistance and gas resistance of such materials. For example, techniques for improving the light resistance and gas resistance of ink jet recording materials include techniques in which the light resistance and gas resistance of the ink receiving layer itself that constitutes the ink jet recording medium are improved (see Japanese Patent Application Laid-Open No. H9-254526, Japanese Patent Application Laid-Open No. H8-164664, Japanese Patent Application Laid-Open No. H5-221115 and Japanese Patent Application Laid-Open No. H7-246769), and techniques in which a film, resin layer or the like which possesses light resistance and gas resistance is laminated on the image surface (see Japanese Patent Application Laid-Open No. H8-252985, Japanese Patent Application Laid-Open No. H8-252883, Japanese Patent Application Laid-Open No. H5-318943, Japanese Patent Application Laid-Open No. H8-174989, Japanese Patent Application Laid-Open No. H8-207429 and Japanese Patent Application Laid-Open No. H9-174995); however, none of these techniques can endow ink jet recording media with sufficient light resistance and gas resistance.

Furthermore, methods in which the recorded surface is coated with various treatment liquids in order to improve the water resistance and light resistance of the recorded surface are described in (for example) Japanese Patent Application Laid-Open No. S57-69054, Japanese Patent Application Laid-Open No. S56-77154, Japanese Patent Application Laid-Open No. S55-150396, Japanese Patent Application Laid-Open No. H2-80279 and Japanese Patent Application Laid-Open No. H2-194958. However, in the methods described in these patent applications, the 1treatment liquid coating process requires manual work or the like following the formation of the recorded surface, so that the methods are inconvenient.

Furthermore, a method in which a material that improves the storage characteristics is used as a treatment ink, and this material is written over the recording ink in order to improve the water resistance, light resistance and writing characteristics of the recording medium is described in Japanese Patent Application Laid-Open No. S58-128862. Moreover, a printing method in which the water resistance and light resistance are improved by spraying and immediately mixing a first liquid (which contains at least a coloring component) and a second liquid, and then fastening and fixing [this mixture] on a transfer-receiving body, is described in Japanese Patent Application Laid-Open No. H3-240557. However, since the protective effects of treatment agents vary according to the type of recording medium involved, a treatment liquid that is suitable for the type of recording medium involved must be selected in order to achieve an appropriate manifestation of the protective effect of the treatment liquid.

As was described above, dye inks suffer from the drawback of susceptibility of discoloration and fading over time as a result of exposure to ultraviolet light, visible light, moisture, nitrogen oxide gases, ozone gas and the like; furthermore, ink jet recording media suffer from the drawbacks of poor light resistance and poor gas resistance. Consequently, printed matter recorded by ink jet recording using such dye inks on such ink jet recording media is especially prone to problems in terms of light resistance and gas resistance.

Accordingly, an object of the present invention is to provide a surface treatment method for recorded matter which makes it possible to improve in a simple manner the light resistance, gas resistance, water resistance, moisture resistance, resistance to thermal yellowing, plasticizer resistance and the like of recorded matter in which images are recorded on a recording medium, as well as improving the luster and friction resistance of such recorded matter, and also to provide a surface-treated product [treated] using this method, and a surface treatment apparatus.

Furthermore, another object of the present invention is to provide a surface treatment apparatus which allows the easy and stable performance of a surface treatment for the purpose of protecting formed images.

Furthermore, another object of the present invention is to provide a surface treatment apparatus which allows the easy surface treatment of the recorded surface by selecting a treatment agent that is suited to the type of recording medium such as glossy paper, matte paper or the like.

DISCLOSURE OF THE INVENTION

As a result of diligent research, the present inventors achieved the abovementioned objects by performing a specified treatment on recorded matter in which images are recording on a recording medium.

The present invention was devised on the basis of the abovementioned findings, and provides a surface treatment method which uses a treatment agent to treat the surface of recorded matter in which images are recorded on a recording medium.

First of all, the present inventors discovered that the abovementioned objects can be achieved by using a treatment agent that contains one or more active constituents selected from the group consisting of sulfur compounds, nitrogen compounds, fluorine compounds, natural resins and synthetic resins, or a treatment agent consisting of water or an organic solvent.

The present invention is based on the abovementioned findings, and provides a surface treatment method for recorded matter in which the surface of recorded matter in which images are recorded on a recording medium is treated using a treatment agent containing one or more active constituents selected from the group consisting of sulfur compounds, nitrogen compounds, fluorine compounds, natural resins and synthetic resins, or a treatment agent consisting of water or an organic solvent, as the abovementioned treatment agent.

Secondly, the present inventors discovered that the abovementioned objects can be achieved by using as the abovementioned treatment agent a treatment agent which is characterized in that this agent is an aqueous solution that contains a water-soluble resin, a light resistance improving agent and an ink fixing agent, and the abovementioned water-soluble resin is a resin which is such that coating the image surface of printed matter (printed matter in which the water-resistant base material in the recording medium is a water-resistant paper with an oxygen permeability of 30 cc/($m^2$×D×atm) or more in an environment with a temperature of 20° C. and a relative humidity of 90%, and in which images have been formed in the ink receiving layer by means of a dye ink) with the abovementioned water-soluble resin at the rate of 7 g/$m^2$ it possible to reduce the oxygen permeability of the abovementioned printed matter in an environment with a temperature of 20° C. and a relative humidity of 90% to a value of 10 cc/($m^2$×D×atm).

The present invention is based on the abovementioned findings, and provides a surface treatment method for recorded matter in which the surface of recorded matter in which images are recorded on a recording medium is treated using a treatment agent which is characterized in that this agent is an aqueous solution that contains a water-soluble resin, a light resistance improving agent and an ink fixing agent, and the abovementioned water-soluble resin is a resin which is such that coating the image surface of printed matter (printed matter in which the water-resistant base material in the recording medium is a water-resistant paper with an oxygen permeability of 30 cc/($m^2$×D×atm) or more in an environment with a temperature of 20° C. and a relative humidity of 90%, and in which images have been formed in the ink receiving layer by means of a dye ink) with the abovementioned water-soluble resin at the rate of 7 g/$m^2$ it possible to reduce the oxygen permeability of the abovementioned printed matter in an environment with a temperature of 20° C. and a relative humidity of 90% to a value of 10 cc/($m^2$×D×atm).

Third, the present inventors discovered that the abovementioned objects can be achieved by using a treatment agent consisting chiefly of oil and fat.

The present invention is based on the abovementioned findings, and provides a surface treatment method for recorded matter in which the surface of recorded matter in which images are recorded on a recording medium is treated using a treatment agent consisting chiefly of oil and fat as the above-mentioned treatment agent.

Fourth, the present inventors discovered that the abovementioned objects can be achieved by using a treatment agent consisting chiefly of oil-form substances.

The present invention is based on the abovementioned findings, and provides a surface treatment method for recorded matter in which the surface of recorded matter in which images are recorded on a recording medium is treated using a treatment agent consisting chiefly of oil-form substances as the abovementioned treatment agent.

Fifth, the present invention provides a surface treatment method comprising the steps of detecting the type of the abovementioned recording medium, determining the treatment agent in accordance with the detected type of the abovementioned recording medium, and discharging the determined treatment agent onto the abovementioned recorded surface so that a protective layer that protects this recorded surface is formed.

Sixth, the present invention provides a surface-treated product which is characterized in that recorded matter is treated using the abovementioned surface treatment method.

Seventh, the present invention provides a surface treatment apparatus for recorded matter in which the surface of recorded matter in which images are recorded on a recording medium is treated using a treatment agent, this surface treatment apparatus comprising a treatment agent discharge part which discharges the abovementioned treatment agent onto the recorded matter.

BEST MODE FOR CARRYING OUT THE INVENTION

Figure 1:
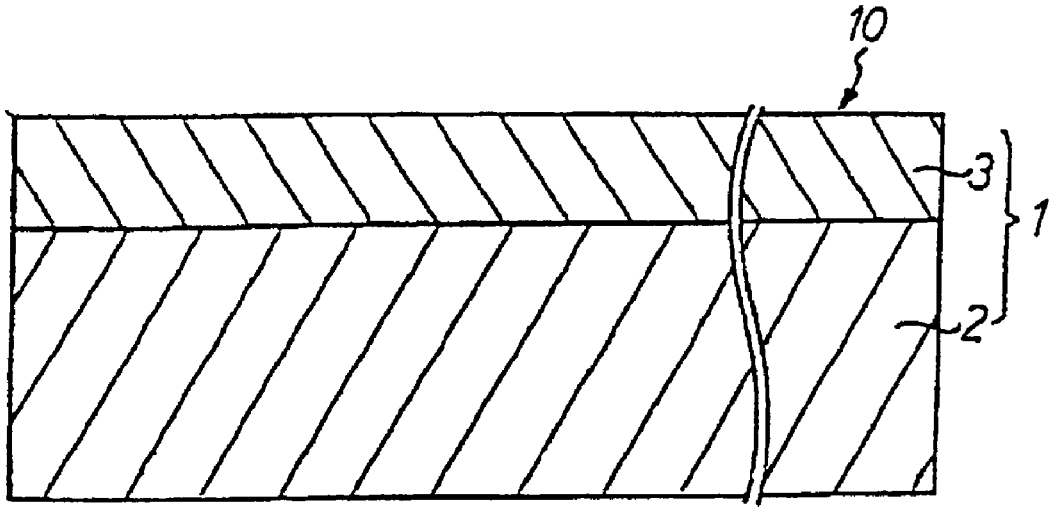
FIG. 1 is an enlarged sectional view which shows an enlarged section of the recording matter used in the surface treatment method of the present invention.

Preferred embodiments of the surface treatment method of the present invention will be described in detail below.

The surface treatment method of the present invention is a method in which the surface of recorded matter in which images are recorded on a recording medium is subjected to an after-treatment using a specified treatment agent. This method makes it possible to improve the weather resistance characteristics such as the light resistance, gas resistance, water resistance, moisture resistance, resistance to thermal yellowing and plasticizer resistance of the recorded matter, as well as the luster and friction resistance of the recorded matter, in a simple manner without any need for bothersome treatments of the type performed in conventional methods. Here, the term "light resistance" refers to the resistance of recorded matter when this recorded matter is exposed to the ultraviolet light of sunlight or the like, or to indoor fluorescent lighting or the like. Furthermore, the term "gas resistance" refers to the resistance of the recorded matter to gases such as $O_3$, $SO_x$, $NO_x$, $H_2S$, $O_2$, CO and the like that are present in the atmosphere. The term "water resistance" refers to the resistance of the recorded matter in cases where water is dropped on the surface of the recorded matter. The term "moisture resistance" refers to the resistance of the recorded matter to moisture present in the atmosphere. The term "resistance to thermal yellowing" refers to the resistance of the recorded matter to yellowing caused by heat. The term "plasticizer resistance" refers to the resistance of the recorded matter to plasticizers. The term "luster" refers to the luster of a 75-degree mirror surface. The term "friction resistance" refers to the resistance of the recorded matter to friction.

Furthermore, in the present invention, the term "recorded matter" refers to images (printed images) recorded (printed) on a recording medium, and the recording medium that contains such images.

(Surface Treatment Method According to First Embodiment)

The specified treatment agents used in the method of the present invention are (1) treatment agents which contain one or more active constituents selected from the group consisting of sulfur compounds, nitrogen compounds, fluorine compounds, natural resins and synthetic resins, or (2) treatment agents which consist of water or an organic solvent.

First, to describe the treatment agents mentioned above under (1), examples of these treatment agents include treatment agents that contain sulfur compounds, treatment agents that contain nitrogen compounds, treatment agents that contain fluorine compounds, treatment agents that contain natural resins, and treatment agents that contain synthetic resins or the like. The active constituents contained in these respective treatment agents have functions that make it possible to manifest the effect of the present invention.

Here, desirable examples of the abovementioned sulfur compounds include thiocyanic acid, thiosulfuric acid, thiourea, thio ether compounds, thiol compounds containing hetero-rings, sulfur halides, sulfur oxyhalides, halogenosulfones and derivative of these compounds. Concrete examples of such compounds are cited below.

For example, thiocyanates such as sodium thiocyanate, potassium thiocyanate, ammonium thiocyanate and the like; thiosulfuric acid; thiourea type compounds such as thiourea, thiosemicarbazide derivatives, thiocarbohydrazide derivatives and the like; thiol compounds containing hetero-rings such as imidazole rings, pyrimidine rings, pyridine rings, purine rings and the like; sulfur halides such as $S_2X_2$ (X indicates F, Cl or Br), $SX_2$ (X indicates F or Cl), $SX_4$ (X indicates F or Cl), $SX_6$ (X indicates F) and the like; sulfur oxyhalides such as $SOX_2$ (X indicates F, Cl or Br), $SO_2X_2$ (X indicates F or Cl) and the like; halogensulfones such as $SO_2(OH)X$ (X indicates F or Cl) and the like; and halogenosulfonic acid.

Furthermore, commercially marketed products may also be used as the abovementioned sulfur compounds; examples of such products include "IRGANOX PS800FL" and "IRGANOX PS802FL" manufactured by Ciba-Geigy Co., "Adekasutabu AO-23", "Adekasutabu AO-412S" and "Adekasutabu AO-503A" manufactured by Asahi Denka Kogyo K.K., "SEENOX 1479S", "SEENOX 412S", "SEENOX D.L.", "SEENOX D.S." and "SEENOX D.M." manufactured by Shipuro Kasei Kogyo K.K., and "DLTP 'Yoshitomi'", "DSTP 'Yoshitomi'" and "DMTP 'Yoshitomi'" manufactured by Yoshitomi Seiyaku K.K.

Furthermore, the commercially marketed products shown here are all shown with the commercial names used by the various firms.

Furthermore, examples of compounds that are desirable for use as the abovementioned nitrogen compounds include aliphatic amine compounds such as alkylamines and the like, alicyclic amine compounds, aromatic amine compounds, quaternary ammonium salts, polyamines and polyamine derivatives, amine condensates, amino acids and amino acid derivatives. Concrete examples of such nitrogen compounds include decylamine acetate, undecylamine acetate, dodecylamine acetate, tridecylamine acetate, tetradecylamine acetate, pentadecylamine acetate, octadecylamine acetate, nonadecylamine acetate, eicosylamine acetate, hydrochlorides of the abovementioned alkylamines, lauryltrimethylammonium bromide or chloride, cetyltrimethylammonium bromide or chloride, octaisoquinolium bromide or chloride, hexadecyltrimethylammonium bromide or chloride, polyamidopolylamines, polyoxyethylenealkylamines, polyethylamine-epichlorohydrins, polydimethylaminoethyl methacrylate, polyalkylammoniums, polyamine latexes, alkylammonium latexes, alanine, methionine, cystine, cysteine and carnitine. Furthermore, the abovementioned nitrogen compounds may be compounds that contain both nitrogen atoms and sulfur atoms in the molecule, as in the case of methionine, cystine and cysteine indicated as examples here.

Furthermore, nonionic, cationic and anionic fluorine-atom-containing surfactants, as well as fluorine-modified resins or the like, are desirable for use as the abovementioned fluorine compounds.

Furthermore, carnauba wax, beeswax, rice wax, Japan wax, hohoba oil, spermaceti, candelilla wax, lanolin, montan wax, ozokerite, ceresin, paraffin wax, microcrystalline wax, petrolactam and the like are desirable for use as the abovementioned natural resins.

Furthermore, all conventional universally known synthetic resins may be used as the abovementioned synthetic resins; examples of such synthetic resins include cellulose type resins such as ethylcellulose, hydroxyethylcellulose, ethylhydroxyethylcellulose, hydroxypropylcellulose, methylcellulose, cellulose acetate, cellulose butyrate, nitrocellulose, cellulose diacetate and the like, vinyl type resins such as polyvinyl alcohols, polyvinyl acetates, polyvinylbutyrals, polyvinylacetals, polyvinylacetoacetals, polyvinylpyrrolidones and the like, acrylic type resins, e.g., acrylic acid polymers, methacrylic acid polymers and derivatives of such polymers such as polyacrylamides, polyacrylonitriles and the like, polyolefin type resins such as polypropylenes and the like, halogen type resins such as polyvinyl chlorides, polyvinylidene chlorides and the like, polyester type resins such as polyethylene terephthalates, polybutylene terephthalates and the like, polystyrene type resins, copolymer type resins consisting of olefins such as ethylene, propylene and the like with other vinyl monomers, ionomer resins, polycarbonate resins, silicone oils, UV-curable resins, thermosetting resins, polyurethane resins, modified epoxy resins, phenol resins and the like. Among these resins, cellulose type resins, vinyl type resins, acrylic type resins, polyester resins, silicone oils, UV-curable resins, thermosetting resins, polyurethane resins, modified epoxy resins and phenol resins are especially effective.

The abovementioned active constituents are contained in the treatment agents in amounts which are such that there is no loss of the effect of the present invention; a content of 0.001 to 100 parts by weight, and preferably 0.1 to 100 parts by weight, per 100 parts by weight of the treatment agent is desirable. By using the active constituents in such a desirable range, it is possible to achieve a great improvement in the weather resistance of the recorded matter.

Among the respective active constituents described above, the sulfur compounds, nitrogen compounds and fluorine compounds respectively contain the essential atoms in the molecule (sulfur atoms in the case of sulfur compounds, nitrogen atoms in the case of nitrogen compounds, and fluorine atoms in the case of fluorine compounds); however, these compounds may also contain other hetero-atoms. For example, compounds which contain both sulfur atoms and nitrogen atoms in the molecule as described above may be cited. Furthermore, the abovementioned compounds may contain one or more types of hetero-atoms in the molecule, and the number of hetero-atoms in each molecule may be one or more.

Furthermore, mixtures of two or more compounds selected from the group consisting of sulfur compounds, nitrogen compounds, fluorine compounds, natural resins and synthetic resins may be used as treatment agents in the present invention. The respective components used in such a mixture are the same as those used in the abovementioned treatment agents containing the respective active constituents singly, and the items described in the above paragraphs (e.g., contents and the like) may be appropriately applied.

In addition to the abovementioned agents, commercially marketed products such as "Lacquer Spray EXE" manufactured by Nippe Home Products K.K., "Daburo Special" manufactured by Kusakabe K.K., "Gosei Jushi Toryo" manufactured by Atomics K.K., "Suisei Nisu" manufactured by Washin Paint K.K., "STEEP1 Spray Wax" manufactured by Suzuka Fine K.K. and the like may also be used as treatment agents that manifest the effect of the present invention. Furthermore, the commercially marketed products shown here are all shown with the commercial names used by the various firms.

The form of the abovementioned treatment agents may be either solid or liquid.

In cases where the abovementioned treatment agents are liquid, water and organic solvents are used as these treatment agents. Such water and organic solvents may be used singly, or both water and organic solvents may be used in combination.

Examples of the abovementioned organic solvents include aromatic hydrocarbons such as benzene, toluene, xylene and the like, hydrocarbons such as hexane, cyclohexane, naphtha, kerosene and the like, halogenated hydrocarbons such as chloroform, carbon tetrachloride, perchloroethylene, trichloroethylene and the like, ketone compounds such as acetone, cyclohexanone, methyl ethyl ketone, methyl isobutyl ketone and the like, amide compounds such as dimethylamide and the like, ether compounds such as ethyl ether, dimethyl ether, dioxane, ethylene glycol, propylene glycol and the like, ester compounds such as butyl acetate and the like, and alcohol type compounds such as methanol, ethanol, isopropyl alcohol and the like, as well as acetonitrile, propylene carbonate and the like.

Next, to describe the treatment agents mentioned above under (2), these treatment agents are agents in which water or organic solvents are used singly. Specifically, these treatment agents consist of water alone (100%) or an organic solvent alone (100%). Here, examples of organic solvents that can be used in treatment agents consisting of organic solvents are the same as the examples of organic solvents that can be used in the treatment agents mentioned above under (1); in particular, however, aromatic hydrocarbons (especially toluene, xylene and the like) and alcohol type compounds (especially isopropyl alcohol and the like) are especially desirable.

In the present invention, even if such treatment agents mentioned above under (2) consisting of water or organic solvents are used, the effect of the present invention can be manifested in the same manner as in the case of the treatment agents mentioned above under (1). The reason for the manifestation of this effect has not been established; however, it is inferred that this results from some type of action such as swelling or the like that is shown by the treatment agents described above under (2) with the resin of the recorded matter that is obtained.

In the method of the present invention, the surface of recorded matter in which images are recorded on a recording medium is subjected to an after-treatment using the abovementioned treatment agents. There are no particular restrictions on the type of this after-treatment; the effect of the present invention can be obtained using any type of after-treatment. However, examples of desirable treatments include spray treatments, blowing treatments, coating treatments, immersion treatments and treatments performed using an ink jet recording head.

Here, the term "spray treatment" refers to a method in which the abovementioned treatment agent accommodated in a spray can is sprayed onto the surface of recorded matter in which images are recorded on a recording medium.

Furthermore, the term "blowing treatment" refers to a method in which the abovementioned treatment agent accommodated in an atomizer or spray-damper is blown onto the surface of recorded matter in which images are recorded on a recording medium.

Furthermore, the term "coating treatment" refers to a method in which the abovementioned treatment agent is applied as a coating to the surface of recorded matter in which images are recorded on a recording medium, with this application being accomplished using a sponge, brush or the like.

Furthermore, the term "immersion treatment" refers to a method in which recorded matter in which images are recorded on a recording medium is immersed in the abovementioned treatment agent.

Furthermore, the term "treatment performed using an ink jet recording head" refers to a method in which the abovementioned treatment agent is discharged by an ink jet recording head onto the surface of recorded matter in which images are recorded on a recording medium.

Among these after-treatments, spray treatments and coating treatments are especially desirable from the standpoint of improving the weather resistance of images.

In cases where the abovementioned treatment agent is a liquid agent in the surface treatment method of the present invention, this treatment liquid can be used as a coating liquid to form an overcoat layer on the recorded matter. In this case, the abovementioned treatment agent can be applied as a coating to the surface of the recorded matter, and then dried to form an overcoat layer. In this case, furthermore, the treatment is performed so that the weight of the abovementioned treatment agent that is applied to the surface of the recorded matter is 0.01 to 30 $g/m^2$, preferably 0.1 to 10 $g/m^2$. By using the abovementioned treatment agent at a weight in this desirable range, it is possible to achieve a great improvement in the weather resistance of the recorded matter.

Furthermore, in cases where the abovementioned treatment agent is a solid agent, the desired surface-treated product can be obtained by (for example) wiping away the treatment agent following the after-treatment.

The surface treatment method of the present invention is especially suitable for use in cases where the images of the recorded matter are color images, especially cyan images. Specifically, in the case of color images consisting of yellow, magenta and cyan, it is been found that cyan images are especially susceptible to deterioration in terms of gas resistance. In such cases, the deterioration of cyan images is conspicuously alleviated by the surface treatment method of the present invention, so that the weather resistance of the recorded matter as a whole can be improved.

There are no particular restrictions on the ink composition used to form the recorded matter in the surface treatment method of the present invention; either ink compositions containing pigments as coloring agents or ink compositions containing dyes as coloring agents may be used.

There are no particular restrictions on the recording medium used to form the recorded matter to which the surface treatment method of the present invention is applied; however, a recording medium in which an ink receiving layer is disposed on a support is desirable. Furthermore, it is especially desirable that this recording medium be an ink jet recording medium.

A material which possesses water resistance, and which tends not to expand or contract as a result of a liquid treatment process, is used as the support (base material) that forms the recording medium. Examples of such supports include papers that have been subjected to a sizing treatment, resin-coated papers formed by coating a paper with a polyethylene, polypropylene, polyester or the like, photographic base materials such a baryta papers, RC papers or the like, thermoplastic resin films consisting of polyethylene terephthalates, polyethylenes, polypropylenes or the like, synthetic papers, and sheet-form materials formed from synthetic fibers.

Furthermore, in regard to inorganic materials used in the ink receiving layer that is used in the abovementioned recording medium, materials that are commonly used in ink jet recording media may be used without any particular restrictions. Examples of ink receiving layers that can be used include layers in which ceramic particles or colloidal particles consisting of colloidal silica, amorphous silica, gel type silica, vapor-phase process silica, colloidal alumina, alumina hydrates such as boehmite, quasi-boehmite or the like, alumina, silica/alumina hybrid sols, aluminum hydroxide, calcium carbonate, calcium hydrogencarbonate, calcium sulfate, kaolin, talc, clay, smectite clay, titanium dioxide, barium sulfate, rutile, zinc oxide, zinc sulfide, zinc carbonate, aluminum silicate, diatomaceous earth, calcium silicate, magnesium silicate, zeolite, halloysite, magnesium carbonate, magnesium hydroxide and the like are applied as coatings by special methods.

From the standpoint of increasing the strength of the ink receiving layer, it is also desirable that the ink receiving layer contain a binder. Examples of binders that can be used include polyvinyl alcohols, silanol-modified polyvinyl alcohols, vinyl acetate, starch, cellulose derivatives such as carboxymethylcellulose and the like, casein, gelatin, conjugated diene type copolymer latexes such as styrene-butadiene copolymers and the like, vinyl type copolymer latexes such as ethylene-vinyl acetate copolymers and the like, and acrylic type copolymer latexes such as copolymers of acrylic acid and methacrylic acid and the like.

The ink receiving layer may also contain assistants. From the standpoints of high printing density and water resistance of the printed matter, it is desirable that the ink receiving layer contain a dye fixing agent as an assistant. Examples of such dye fixing agents include cationic organic substances, polyvalent metal ions, cationic surfactants and the like.

Examples of cationic organic substances include low-molecular compounds such as primary to tertiary amine compounds, primary to tertiary amine salts, quaternary ammonium salts and the like, and oligomers which have primary to tertiary amino groups, primary to tertiary amine salt groups or quaternary ammonium salt groups, or polymers which have such groups. Concrete examples of such compounds include diallyldimethylammonium chloride polymers, epihalohydrin-secondary amine copolymers, diallyldimethylammonium chloride-sulfur dioxide copolymers, dimethylmethylammonium chloride-acrylamide copolymers, diarylmethylammonium salt polymers, diarylamine hydrochloride-sulfur dioxide copolymers, dimethylmethylamine hydrochloride copolymers, polyallylamines, polyethyleneimines, polyethyleneimine quaternary ammonium salt compounds, (meth)acrylamide alkylammonium salt polymers, and ionenes containing quaternary ammonium salt groups. Examples of polyvalent metal ions include $Al^{3+}$, $Ca^{2+}$, $Mg^{2+}$ and the like. Examples of cationic surfactants include benzalkonium chlorides and the like.

Examples of other assistants that can be used include light stabilizers, fluorescent whiteners, ultraviolet absorbing agents, waterproofing agents, anti-oxidants, anti-mold agents, dispersing agents, surfactants, thickeners, pH adjusting agents, defoaming agents and the like.

It is desirable that the ink receiving layer contain vapor-phase process silica as the abovementioned pigment, and it is desirable from the standpoint of improving the image quality such as the smoothness and resolution of the ink receiving layer that the mean particle size of this silica be 0.01 to 1 m, preferably 0.1 to 0.5 m. Furthermore, it is desirable from the standpoint of ink absorption characteristics that the specific surface area of the ink receiving layer be 150 to 350 $m^2/g$, preferably 250 to 300 $m^2/g$.

It is desirable from the standpoints of water resistance and moisture resistance that the abovementioned ink receiving layer contain 30 to 80 wt % (preferably 50 to 70 wt %) vapor-phase process silica as the abovementioned pigment, 20 to 60 wt % (preferably 30 to 50 wt %) polyvinyl alcohol as the abovementioned binder, and 5 to 30 wt % (preferably 10 to 20 wt %) secondary amine-epichlorohydrin polymer as a dye fixing agent constituting the abovementioned assistant, calculated in terms of solid content.

Furthermore, the ink receiving layer may be a resin layer consisting of a polymer or copolymer such as a starch derivative, carboxymethylcellulose (CMC), hydroxyethylcellulose (HEC), casein, gelatin, polyvinyl alcohol, polyvinylpyrrolidone, melamine resin, urea resin, urethane resin, unsaturated polyester resin, maleic anhydride resin, styrene-butadiene resin, acrylic acid derivative, methacrylic acid derivative or the like, and may be a swelling type ink receiving layer that is caused to swell by the ink.

Furthermore, instead of the abovementioned materials, a layer with voids containing fine inorganic particles to which an organic cationic polymer is bonded (see Japanese Patent Application Laid-Open No. H11-58942) or a layer obtained by using fine inorganic particles, a water-soluble resin and a specified crosslinking agent, and crosslinking and hardening the abovementioned water-soluble resin while a constant drying rate is shown (see Japanese Patent Application Laid-Open No. H11-115308) may also be used as the ink receiving layer. In addition, the ink receiving layer may also be changed to the ink receiving layers described in Japanese Patent Application Laid-Open No. H10$^{-81064}$, Japanese Patent Application Laid-Open No. H10-100397, Japanese Patent Application Laid-Open No. H10-119420, Japanese Patent Application Laid-Open No. H10-119423, Japanese Patent Application Laid-Open No. H10$^{-119424}$, Japanese Patent Application Laid-Open No. H10-175365, Japanese Patent Application Laid-Open No. H10-193776, Japanese Patent Application Laid-Open No. H10-203006, Japanese Patent Application Laid-Open No. H10-217601, Japanese Patent Application Laid-Open No. H11-20300, Japanese Patent Application Laid-Open No. H11-20306, Japanese Patent Application Laid-Open No. H7-276789, Japanese Patent Application Laid-Open No. H8-174992 and the like.

Furthermore, it is desirable that the amount of the abovementioned ink receiving layer that is applied as a coating to the support (base material) be in the range of 5 to 40 g/m$^2$ in terms of solid content, and an amount in the range of 10 to 30 g/m$^2$ is even more desirable. The thickness of the ink receiving layer itself is preferably 5 to 80 μm, and is even more preferably 20 to 60 μm.

Furthermore, the ink receiving layer may be formed on one side of the base material or on both sides of the base material. Moreover, from the standpoint of improving the image quality, a smoothing treatment may be performed on the ink receiving layer using a universally known calender device.

The surface treatment method of the present invention makes it possible to provide a surface-treated product (surface-treated recorded matter) in which the weather resistance properties, and especially the light resistance and gas resistance, are improved.

(Surface Treatment Method According to Second Embodiment)

Below, a surface treatment method according to a second embodiment of the present invention will be described with reference to FIGS. 1 and 2.

First, the printed matter 10 that is the object of the surface treatment will be described.

As is shown in FIG. 1, the printed matter 10 is printed matter in which images and/or characters (not shown in the figures) are formed by a dye ink on a recording medium 1 in which an ink receiving layer 3 is disposed on a water-resistant base material 2. The recording medium 1 and the abovementioned dye ink that form the printed matter 10 are the same as those [ordinarily] used in printed matter of this type.

A material which possesses water resistance, and which tends not to expand or contract as a result of a liquid treatment process, is used as the water-resistant base material 2 that forms the recording medium 1. Examples of such materials include papers that have been subjected to a sizing treatment, resin-coated papers formed by coating a paper with a polyethylene, polypropylene, polyester or the like, photographic base materials such a baryta papers, RC papers or the like, thermoplastic resin films consisting of polyethylene terephthalates, polyethylenes, polypropylenes or the like, synthetic papers, and sheet-form materials formed from synthetic fibers.

From the standpoint of improving the gas resistance, it is desirable that the oxygen permeability of the water-resistance base material 2 in an environment with a temperature of 20° C. and a relative humidity of 90% be 50 cc/(m$^2$×D×atm) or less, and a value of 30 cc/(m$^2$×D×atm) or less is even more desirable. Furthermore, the method used to measure the oxygen permeability will be described later. The relative humidity is measured according to JIS W 0110.

The ink receiving layer 3 that constitutes the recording medium 1 is formed in the same manner as in the first embodiment.

The abovementioned dye ink that forms the printed matter may be any dye ink that is commonly used in ink jet recording; however, the surface treatment method for printed matter provided by the present invention is especially effective on printed matter in which an aqueous dye ink is used as the abovementioned dye ink. Such aqueous dye inks ordinarily consist of a dye, a solvent and assistant chemicals.

Examples of dyes that can be used in the above-mentioned aqueous dye inks include water-soluble dyes such as direct dyes, acidic dyes, basic dyes, reactive dyes, food coloring and the like.

Examples of solvents that can be used in the abovementioned aqueous dye inks include water and various types of water-soluble organic solvents, e.g., alkyl alcohols with 1 to 4 carbon atoms such as methyl alcohol, ethyl alcohol and the like, and polyhydric alcohols such as glycerol, ethylene glycol and the like.

Examples of assistant chemicals that can be used in the abovementioned aqueous dye inks include wetting agents, dispersing agents, defoaming agents, surface tension adjusting agents, anti-mold agents, pH adjusting agents, antioxidants, viscosity adjusting agents and the like.

The printed matter that is the object of the surface treatment method of the present invention is printed matter in which images and/or characters are recorded by ink jet recording on the abovementioned recording medium using the above-mentioned dye ink. The constitution of this printed matter does not differ in any particular way from that of conventional printed matter of this type. The "ink jet recording" system referred to here is a system which is capable of directly discharging liquid droplets of the abovementioned dye ink onto the abovementioned recording medium from a nozzle, and causing these ink droplets to adhere to the recording medium.

Next, the surface treatment method applied to the printed matter 10 will be described.

The treatment agent used in the surface treatment method of the present embodiment is an aqueous solution which contains a water-soluble resin, preferably at the rate of 1 to 70 wt %, and even more preferably at the rate of 5 to 15 wt %, a light resistance improving agent, preferably at the rate of 0.01 to 20 wt %, and even more preferably at the rate of 0.3 to 2 wt %, and an ink fixing agent, preferably at the rate of 0.01 to 10 wt %, and even more preferably at the rate of 0.5 to 5 wt %.

By setting the contents of the respective components of the abovementioned treatment agent within the respective ranges mentioned above, it is possible to improve the light resistance and gas resistance of the printed matter much more effectively without exerting any deleterious effect on the images and/or characters.

The abovementioned water-soluble resin is a resin which is such that coating the image surface of printed matter (printed matter in which the water-resistant base material in the recording medium is a water-resistant paper with an oxygen permeability of 30 cc/($m^2$×D×atm) or more in an environment with a temperature of 20° C. and a relative humidity of 90%, and in which images have been formed in the ink receiving layer by means of a dye ink) with the abovementioned water-soluble resin at the rate of 7 g/$m^2$ it possible to reduce the oxygen permeability of the abovementioned printed matter in an environment with a temperature of 20° C. and a relative humidity of 90% to a value of 10 cc/($m^2$×D×atm) or less. Here, the printed matter which is coated with the abovementioned water-soluble resin is the printed matter 10 that is the object of the surface treatment method of the present embodiment. The printed matter 10 can be endowed with a sufficient gas resistance by treating the printed matter 10 with the abovementioned treatment liquid containing such a water-soluble resin.

Furthermore, in stipulating the relationship between the amount of the abovementioned water-soluble resin that is applied as a coating and the abovementioned oxygen permeability, it goes without saying that water-soluble resins that are capable of lowering the abovementioned oxygen permeability to a value of 10 cc/($m^2$×D×atm) even when the abovementioned coating amount is less than 7 g/$m^2$, e.g., 3 g/$m^2$, 1 g/$m^2$ or 0.1 g/$m^2$, are also included.

The oxygen permeability values of the abovementioned water-resistant base material and the printed matter coated with the abovementioned water-soluble resin are values that were measured in accordance with ASTM-D1434.

Preferable examples of the abovementioned water-soluble resin include ethylene-polyvinyl alcohol copolymers (also referred to as "evals"), polyvinylidene chloride emulsions and polyvinyl alcohols. Ethylene-polyvinyl alcohol copolymers are especially desirable from the standpoint of preventing the permeation of oxygen and water vapor.

The abovementioned light resistance improving agents may be any agents that are water-soluble and that have the effect of inhibiting the discoloration or fading of recorded images caused by ultraviolet light and visible light. Preferably, such agents consist of one or more substances selected from the group consisting of ultraviolet absorbing agents, hindered amine light stabilizers (HALS) and quenchers (light quenching agents). Ultraviolet absorbing agents and HALS are especially desirable from the standpoint of preventing light-caused deterioration of dye inks.

Examples of ultraviolet absorbing agents that can be used include benzophenone type, salicylate type, benzotriazole type and cyanoacrylate type agents, as well as metal oxides such as titanium oxide, zinc oxide, selenium oxide, cerium oxide and the like.

Various commercially marketed products may be used as hindered amine type light stabilizers. Concrete examples include hindered amine compounds such as "Adekasutabu LA-77", "Adekasutabu LA-87", "Adekasutabu LA-82", "Adekasutabu LA-52", "Adekasutabu LA-57", "Adekasutabu LA-62", "Adekasutabu LA-63" and "Adekasutabu LA-68" (all commercial names of products manufactured by Asahi Denka K.K.), "Cynol LS770" and "Cynol LS440" (both commercial names of products manufactured by Sankyo K.K.), "Tinuvin 292", "Tinuvin 123", "Tinuvin 144", "Tinuvin 440", "Tinuvin 622" and "Chlmassorb [sic] 944" (all commercial names of products manufactured by Ciba-Geigy Co.), "Goof-rite 3034" (commercial name of a product manufactured by B. F. Goodrich Co.), "Cyasorb UV3346" (commercial name of a product manufactured by Cytec Co.) and the like. These products may be used singly or in mixtures consisting of two or more produced.

Examples of quenchers that can be used include metal complexes of nickel, cobalt and the like.

The abovementioned ink fixing agent may be any agent that has the effect of preventing the dye ink from running out when the printed matter 10 is treated with the abovementioned treatment liquid. Preferably, this ink fixing agent consists of one or more agents selected from the group consisting of cationic organic substances, polyvalent metal ions and cationic surfactants. Cationic organic substances, polyvalent metal ions and cationic surfactants that can be used are respectively the same as those substances used as the ink fixing agent described above. In particular, cationic organic substances, and especially epihalohydrin-secondary amine copolymers, are desirable from the standpoint of improving the fixing properties of dye inks without damaging the light resistance of such dye inks.

In addition to the respective components described above (water-soluble resin, light resistance improving agent and ink fixing agent), assistants may be appropriately mixed with the abovementioned treatment liquid as required. For example, one or more preservatives, anti-mold agents, viscosity adjusting agents or the like may be used as assistants.

In cases where the abovementioned assistants are mixed with the aqueous solution constituting the abovementioned treatment liquid, the contents of these assistants may be appropriately selected in accordance with the type of assistant; preferably, however, the content is 0.1 to 10 wt % (even more preferably 1 to 5 wt %) of the aqueous solution.

The abovementioned treatment liquid is prepared as an aqueous solution by appropriately mixing the abovementioned components (and the abovementioned assistants if necessary). The further addition of an alcohol is desirable from the standpoint of quickly drying the printed matter 10 treated by the abovementioned treatment liquid, so that the treated printed matter 10 is cleanly finished. One or more alcohols selected from the group of alcohol type organic solvents in the first embodiment is appropriate for use as the above-mentioned alcohol. In particular, ethanol is especially desirable from the standpoints of stability and quick-drying properties.

In cases where an alcohol is further added to the abovementioned treatment liquid as described above, the content of this alcohol is preferably 1 to 80 wt %, and even more preferably 20 to 50 wt %, of the aqueous-solution.

From the standpoints of facilitating treatment of the printed matter 10 by the abovementioned treatment liquid and cleanly finishing the surface of the printed matter following treatment, it is desirable that the concentration of the solid content of the abovementioned treatment liquid be in the range of 0.1 to 50 wt %, and a concentration in the range of 1 to 15 wt % is even more desirable. Furthermore, it is desirable that the viscosity of the abovementioned treatment liquid be in the range of 1 to 100 cps, and a viscosity in the range of 5 to 50 cps is even more desirable. For example, an alcohol such as ethanol or the like may be added as one of the abovementioned assistants (in cases where the viscosity is to be lowered), or carboxymethylcellulose, starch or the like may be added (in cases where the viscosity is to be raised), in order to maintain the viscosity within the above-mentioned The surface treatment method for printed matter in the present embodiment is a method in which the abovementioned printed matter 10 is treated with the abovementioned treatment liquid; this method is performed as follows:

First, the printed matter 10 is impregnated with the abovementioned treatment liquid. It is desirable that the method used for this impregnation be a method in which the entire printed matter 10 is immersed in the above-mentioned treatment liquid for approximately 10 seconds. If the immersion time is too short, the printed matter 10 will not be sufficiently impregnated with the treatment liquid. On the other hand, even if the immersion time is extended to an excessively long time, the effect of the treatment in preventing deterioration becomes saturated, and problems such as leakage and peeling of the ink receiving layer occur.

The printed matter 10 that has thus been subjected to an immersion treatment is subsequently dried. In particular, air draft drying by means of a warm air current is especially desirable as the drying method. In the case of the surface treatment method for printed matter of the present embodiment, the printed matter 10 is treated with the abovementioned treatment liquid having the abovementioned composition; accordingly, the printed matter 10 in a wet state can be quickly and sufficiently dried using a household drier or the like. The degree of drying is set so that the water content of the printed matter 10 following drying is preferably reduced to 15 wt % or less, or is even more preferably reduced to 8 wt % or less.

Figure 2:
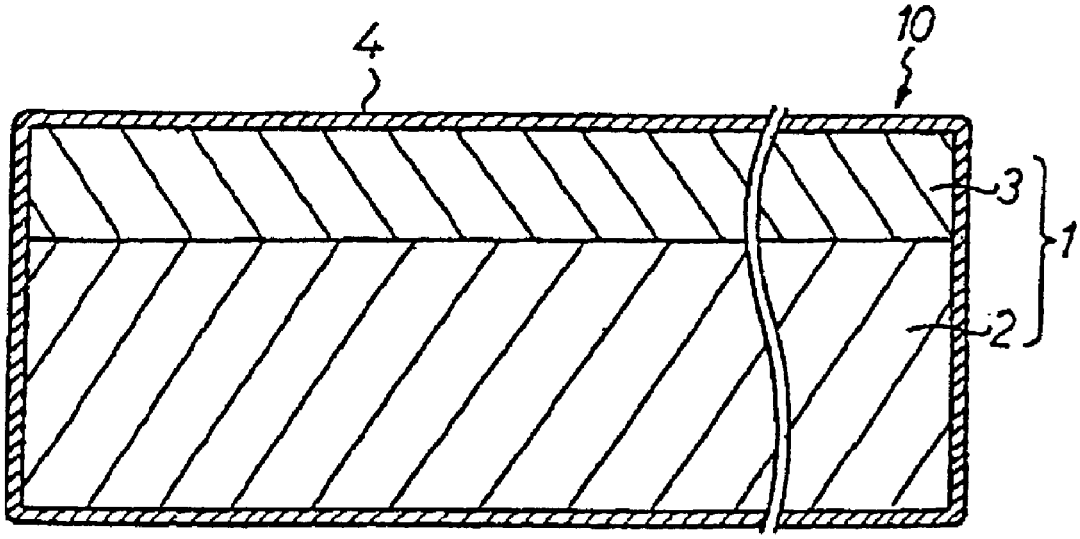
FIG. 2 is an enlarged sectional view which shows an enlarged section of the recording matter (following treatment) treated by the surface treatment method of the present invention.

In the printed matter 10 which is impregnated with the abovementioned treatment liquid and dried as described above, the ink receiving layer 3 in which images or the like are formed is covered by a protective layer 4 which thickness is preferably 0.1 to 50 μm, and even more preferably 1 to 10 μm as shown in FIG. 2. The thickness of the protective layer 4 can be set in the abovementioned range by adjusting the solid concentration and viscosity of the abovementioned treatment liquid and the immersion time in the treatment liquid; in concrete terms, in forming a protective layer 4 with the abovementioned thickness, it is desirable adjust the abovementioned treatment liquid so that a protective layer with the abovementioned thickness is formed with the coating amount of the abovementioned treatment liquid set at 0.5 to 7 g/m$^2$, and so that the oxygen permeability of this protective layer is 10 cc/(m$^2$×D×atm) or less. In this case, furthermore, it is desirable to adjust the above-mentioned treatment liquid so that the coating amount of the abovementioned water-soluble resin is 5 to 7 g/m$^2$, and so that the oxygen permeability of the abovementioned protective layer is 10 cc/(m$^2$×D×atm) or less. In the case of resins in which the oxygen permeability cannot be lowered to 10 cc/(m$^2$×D×atm) or less unless the coating amount exceeds 7 g/m$^2$, there is a deterioration in the surface properties of the printed matter following treatment; accordingly, such resins are undesirable. By forming such a protective layer 4 on the surface of the ink receiving layer 3, it is possible to endow the printed matter 10 with sufficient light resistance and gas resistance.

Furthermore, in the present embodiment, since the printed matter 10 is treated by a method in which the untreated printed matter 10 is impregnated with the above-mentioned treatment liquid, the protective layer 4 is formed not only on the ink receiving layer 3, but also on the side surfaces and back surface of the printed matter 10 (i.e., on the water-resistant base material 2).

The printed matter 10 that is the object of the surface treatment method of the present embodiment may be any printed matter in which images and/or characters are formed by means of a dye ink on a recording medium in which an ink receiving layer is disposed on a water-resistant base material; however, an especially desirable configuration of this printed matter is as follows:

An RC paper (silver halide photographic base material) is desirable as the abovementioned water-resistant base material 2; the weight of this paper is preferably 150 to 300 g/m$^2$, and is even more preferably 200 to 250 g/m$^2$.

In the printed matter 10 that is the object of the surface treatment method of the present embodiment, it is desirable that images and/or characters be formed by an ink jet printer.

The surface treatment method for printed matter provided by the present invention is not limited to the above-mentioned embodiments; various alterations are possible.

For example, in the present embodiment, the method used to treat the printed matter 10 with the abovementioned treatment liquid was a method in which the printed matter 10 was immersed in the abovementioned treatment liquid. However, as in the first embodiment above, it would also be possible to spray the abovementioned treatment liquid onto the printed matter 10 using a spray or the like; alternatively, it would also be possible to coat the printed matter using a coating tool such as a roll bar or the like, or to perform a blowing treatment or a treatment by means of an ink jet recording head.

Furthermore, it is sufficient if the protective layer 4 is formed on the ink receiving layer 3; this protective layer 4 may be formed on one side of the water-resistant base material 2, or on both sides of this material.

Furthermore, in cases where the protective layer 4 is formed on one side of the printed matter 10, a back coating layer may be formed beforehand on the opposite side of the water-resistant base material 2 from the ink receiving layer 3 in order to prevent curling of the printed matter 10.

Furthermore, in the abovementioned embodiment, an ink jet recording system was used as the method of forming images or the like on the recording medium 1. However, any method that is capable of forming images or the like using a dye ink may be used; for example, images or the like may also be formed using a sublimation type thermal transfer system, thermal fusion type thermal transfer system or the like.

In the surface treatment method of the present invention, a protective layer of a specified treatment agent is formed on the surface of the printed matter by treating the printed matter with a specified treatment liquid, so that the weather resistance characteristics such as the light resistance, gas resistance, water resistance and the like of the printed matter are improved. Accordingly, the configuration of the protective layer that is formed on the surface of the printed matter by the method of the present invention may be any configuration which is such that the dried substance formed by drying the specified treatment agent covers the printed matter so that the images and/or characters of the printed matter are shielded from the atmosphere.

(Surface Treatment Method According to Third Embodiment)

A third embodiment of the surface treatment method of the present invention will be described below.

The surface treatment agent used in the present method contains oil and fat as the principal constituents of this agent. Examples of such surface treatment agents include agents prepared by using olive oil, cottonseed oil, soybean oil, rapeseed oil, corn oil, sunflower seed oil, safflower oil, Aleurites moluccana seed nut oil or the like as raw materials, and refining these raw materials. The active constituents contained in these surface treatment agents are constituents that have functions capable of manifesting the effect of the present invention.

Here, glycerol esters of fatty acids are desirable as oil and fat. Examples of glycerol esters of fatty acids include glycerol triesters of fatty acids, glycerol diesters of fatty, glycerol monoesters of fatty acids and mixtures of these esters. Glycerol triesters of fatty acids are especially desirable.

In particular, triglycerides consisting chiefly of linolic acid, oleic acid, linolenic acid, palmitic acid or stearic acid are especially desirable. Alternatively, triglycerides containing two types of acids, such as triglycerides consisting chiefly of linolic acid and linolenic acid or triglycerides consisting chiefly of linolic acid and oleic acid, as well as triglycerides containing three types of acids, are also desirable for use.

The abovementioned oil and fat may also contain complex lipids such as phospholipids and the like, free fatty acids, long-chain alcohols, sterols, hydrocarbons such a squalene and the like, oil-soluble vitamins and non-saponified substances such as coloring agents, etc. The oil and fat used in the present invention may be either liquid or solid substances; furthermore, these oil and fat may be either vegetable oil and fat or animal oil and fat.

The abovementioned oil and fat are contained in the surface treatment agent in amounts that cause no loss of the effect of the present invention; it is desirable that the content of such oil and fat be 50 parts by weight to 100 parts by weight, and preferably 70 parts by weight to 100 parts by weight, per 100 parts by weight of the surface treatment agent. By using the active constituents in such a desirable range, it is possible to achieve a great improvement in the gas resistance of the recorded matter.

Furthermore, mixtures of two or more different types of oil and fat may also be used as the surface treatment agent in the present invention. Moreover, such oil and fat may also be mixed with compatible solvents. Respective components that can be used in such mixtures are the same as the components used in surface treatment agents containing the above-mentioned active constituents singly. The example compounds and example contents described in the paragraphs above may be appropriately used.

Oil-soluble anti-oxidants that can be added to the surface treatment agent include all common oil-soluble anti-oxidants. Examples of oil-soluble anti-oxidants that can be used include 2,6-t-butyl-p-cresol, 2,6-t-butyl-4-ethylphenol, BHA, BHT, 4,4'-methylenebis(3-methyl-6-t-butylphenol), 4,4-thiobis(3-methyl-6-t-butylphenol), 4,4'-thiobis(4-methyl-6-t-butylphenol), 2,4-dimethyl-6-t-butylphenol, 4-isooctylphenol, hydroquinone, 2,4-dioxybenzophenone, 2-oxy-4-methoxybenzophenone, diphenylolpropane, 2,2-bis-(3-methyl-4-oxyphenol)propane, 1,1-bis-(4-oxyphenyl) cyclohexane, 2,2',4,4'-tetraoxyadipophenone, 2,2',4,4'-tetraoxysebaciphenone, dodecahydrotriphenylene, trimolecular condensates of cyclohexanone, hexamolecular condensates of cyclohexanone, resorcine dibenzoate, disalicylresorcine, phenyl salicylate, β-naphthoxypropene oxide and the like. Furthermore, tocopherol type compounds such as α-tocopherol, β-tocopherol, γ-tocopherol, δ-tocopherol, tocopherol acetate and the like, bisphenol type compounds such as 2,2-bis(4-hydroxyphenyl)propane, 2,2-bis(4-hydroxyphenyl)butane, 2,2-bis (4-hydroxy-3-methylphenyl) propane, 2,2-bis(4-hydroxy-3-isopropylphenyl)propane, 2,6-bis(2-hydroxy-5-methylbenzyl)-4-methylphenol, bis(2-hydroxy-5-chlorophenyl) sulfide, bis(2-hydroxy-5-methylphenyl) sulfide and the like, and sulfurous acid ester type compounds such as triphenyl phosphite, diphenyldecyl phosphite, didecylphenyl phosphite, tridecyl phosphite, trioctadecyl phosphite, trinonylphenyl phosphite, tridodecyl trithiophosphite and the like. These oil-soluble anti-oxidants may be used singly, or may be used in combinations consisting of two or more anti-oxidants. It is desirable that the content of such oil-soluble anti-oxidants be 0.001 parts by weight to 20 parts by weight, preferably 0.005 parts by weight to 10 parts by weight, per 100 parts by weight of the surface treatment agent.

Oil-soluble ultraviolet absorbing agents that can be added to the surface treatment agent include all commonly used oil-soluble ultraviolet absorbing agents. Examples of such oil-soluble ultraviolet absorbing agents include salicylic acid phenyl ester type compounds such as phenyl salicylate, p-tert-butylphenyl salicylate, p-octylphenyl salicylate and the like, benzophenone type compounds such as 2,4-dihydroxybenzophenone, 2-hydroxy-4-acetoxyethoxybenzophenone, 2-hydroxy-4-methoxybenzophenone, 2,2'-dihydroxy-4-methoxybenzophenone, 2,2'-di-hydroxy-4,4'-methoxybenzophenone, 2-hydroxy-4-n-octoxybenzophenone, 2-hydroxy-4-iso-octoxybenzophenone, 2-hydroxy-4-dodecyloxybenzophenone, 2-hydroxy-4-octadecyloxybenzophenone, 2,2'-dihydroxy-4,4'-dimethoxy-5,5'-disulfobenzophenone-di-sodium, 2-hydroxy-4-(2-hydroxy-3-methacryloxy)propoxybenzophenone and the like, benzotriazole type compounds such as 2(2'-hydroxy-5'-methylphenyl)benzotriazole, 2(2'-hydroxy-3',5'-di-tert-butylphenyl)benzotriazole, 2(2'-hydroxy-3'-tert-butyl-5'-methylphenyl-5-chlorobenzotriazole, 2(2'-hydroxy-3',5'-di-tert-butylphenyl)-5-chlorobenzotriazole, 2(2'-hydroxy-3',5'-di-tert-aminophenyl)benzotriazole, 2(2'-hydroxy-5'-tert-butylphenyl)benzotriazole, 2(2'-hydroxy-5'-tert-octylphenyl)benzotriazole and the like, benzoate type compounds such as 2',4'-di-tert-butylphenyl-3,5-di-tert-butyl-4-hydroxybenzoate and the like, and cyanoacrylate type compounds such as ethyl-2-cyano-3,5-diphenyl acrylate and the like. It is desirable that that the content of such oil-soluble ultraviolet absorbing agents be 0.01 parts by weight to 20 parts by weight, and preferably 0.1 parts by weight to 10 parts by weight, per 100 parts by weight of the surface treatment agent.

Oil-soluble light stabilizers that can be added to the surface treatment agent include all commonly used oil-soluble light stabilizers. Examples of such oil-soluble light stabilizers (indicated by their commercial names) include hindered amine type compounds such as Adekasutabu LA-77, Adekasutabu LA-87, Adekasutabu LA-82, Adekasutabu LA-52, Adekasutabu LA-57, Adekasutabu LA-62, Adekasutabu LA-63 and Adekasutabu LA-68 (Asahi Denka), Cynol LS770 and Cynol LS440 (Sankyo), Tinuvin 292, Tinuvin 123, Tinuvin 144, Tinuvin 440, Tinuvin 622 and Chlmassorb 944 (Ciba-Geigy), Goof-rite UV3034 (B. F. Goodrich), Cyasorb UV3346 (Cytec) and the like. It is desirable that the content of such oil-soluble light stabilizers be 0.01 parts by weight to 20 parts by weight, preferably 0.1 parts by weight to 10 parts by weight, per 100 parts by weight of the surface treatment agent.

The surface treatment agent may also contain additives such as preservatives, antimicrobial agents, leveling agents and the like.

Next, the surface treatment method of the present invention will be described.

In the present invention, the surface of recorded matter in which images are recorded on a recording medium is treated using the abovementioned surface treatment agent. As in the abovementioned first embodiment, examples of desirable treatment methods include spray treatments, blowing treatments, coating treatments, immersion treatments, treatments using an ink jet recording head and the like.

Among these surface treatment methods, spray treatments and coating treatments are especially desirable from the standpoint of improving the gas resistance of the images.

In the surface treatment method of the present invention, the surface treatment agent is a liquid agent; accordingly, this surface treatment agent can also be used as a coating liquid in forming an overcoat layer on the recorded matter. In this case, the abovementioned treatment agent can be applied as a coating to the surface of the recorded matter, and then dried to form an overcoat layer. In this case, furthermore, the treatment is performed so that the weight of the abovementioned treatment agent that is applied to the surface of the recorded matter is 1 to 50 g/m$^2$, preferably 5 to 30 g/m$^2$. By using the abovementioned treatment agent at a weight in this desirable range, it is possible to achieve a great improvement in the gas resistance and luster of the recorded matter.

The surface treatment method of the present invention is especially suitable for use in cases where the images of the recorded matter are color images, especially cyan images. Specifically, in the case of color images consisting of yellow, magenta and cyan, it is been found that cyan images are especially susceptible to deterioration in terms of gas resistance. In such cases, the deterioration of cyan images is conspicuously alleviated by the surface treatment method of the present invention, so that the gas resistance of the recorded matter as a whole can be improved.

A recording medium similar to that used in the first embodiment is desirable as the recording medium used to form the recorded matter to which the surface treatment method of the present invention is applied.

In cases where voids are formed in the ink receiving layer for the purpose of causing the ink receiving layer to absorb ink or the purpose of causing the absorption of ink in voids in the pigment itself, the gas resistance and luster can be conspicuously improved by applying the surface treatment method of the present invention. The improving effect of the surface treatment method of the present invention is conspicuous in cases where the void ratio of the ink receiving layer measured using JAPAN TAPPI NO. 48-85 is 30% or greater.

The surface treatment method of the present invention makes it possible to provide a surface-treated product (surface-treated recorded matter) in which the weather resistance (such as gas resistance and the like) and luster of the recorded matter are improved.

(Surface Treatment Method According to Fourth Embodiment)

A fourth embodiment of the surface treatment method of the present invention will be described below.

The surface treatment agent used in the present method contains an oil-form substance as its main component. The term "oil-form substance" refers to a substance which is viscous and insoluble in water, which has a smaller specific gravity than water, and which is combustible. Such substances include petroleum type substances and animal and vegetable substances. Such oil-form substances may consist of a single component, or of a variety of components. It is desirable that such oil-form substances be non-volatile liquids at ordinary temperatures. Furthermore, it is desirable that such oil-form substances have a low volatility and a high boiling point. In concrete terms, the boiling point is preferably 200° C. or higher, and even more preferably 300° C. or higher, at 760 mmHg. It is desirable that such oil-form substances be mineral oils extracted from crude oil or petroleum; from the standpoint of odor, paraffin oil or liquid paraffin is desirable.

In particular, in cases where liquid paraffin is used, the liquid paraffin forms a film on the surface of the recorded matter, so that the weather resistance and luster are improved. It is desirable that the viscosity of such liquid paraffin be 5 cSt (40° C.) to 50 cSt (40° C.)

The abovementioned oil-form substances are contained in the surface treatment agent in amounts that cause no loss of the effect of the present invention. It is desirable that the content of such oil-form substances be 50 parts by weight to 100 parts by weight, and preferably 70 parts by weight to 100 parts by weight, per 100 parts by weight of the surface treatment agent. By using active constituents in such a desirable range, it is possible to achieve a great improvement in the weather resistance and luster of the recorded matter.

Furthermore, mixtures consisting of two or more different types of oil-form substances may also be used as the surface treatment agent in the present invention. Moreover, these oil-form substances may also be mixed with compatible solvents. The respective components used in these mixtures are the same as those used in surface treatment agents that contain the abovementioned respective active constituents singly, and the example compounds and example contents described in the above paragraphs may be appropriately applied.

Oil-soluble anti-oxidants, oil-soluble ultraviolet absorbing agents and oil-soluble light stabilizers which can be added to the surface treatment agent are the same as those used in the treatment agent of the abovementioned third embodiment. Furthermore, the surface treatment methods using this surface treatment agent are the same as in the abovementioned third embodiment.

Furthermore, it is desirable that the recording medium used to form the recorded matter to which the surface treatment method of the present invention is applied be the same as that used in the first embodiment.

The surface treatment method of the present invention makes it possible to provide a surface-treated product (surface-treated recorded matter) in which the weather resistance characteristics such as the gas resistance, light resistance, resistance to thermal yellowing, water resistance, moisture resistance and plasticizer resistance of the recorded matter are improved.

(Surface Treatment Method According to Fifth Embodiment)

A fifth embodiment of the surface treatment method of the present invention will be described below.

The present method is realized using (for example) a printer which has detection means for detecting the type of recording medium, and control means for determining which of the abovementioned two or more types of treatment agents is to be applied as a coating to the recorded surface.

Here, examples of desirable detection means include light detection means for discriminating and detecting reflected light on the basis of differences in reflectivity between glossy paper and matte paper, bar code reading means for reading bar codes applied beforehand to the recording medium or recording medium packaging material, and IC readers or the like.

Furthermore, the control means may be disposed in the printer or in an external device outside the printer.

(Surface Treatment Apparatus According to Sixth Embodiment)

[Printer]

Next, a printer used in the present invention, and the operation of this printer, will be described with reference to FIG. 3.

Figure 3:
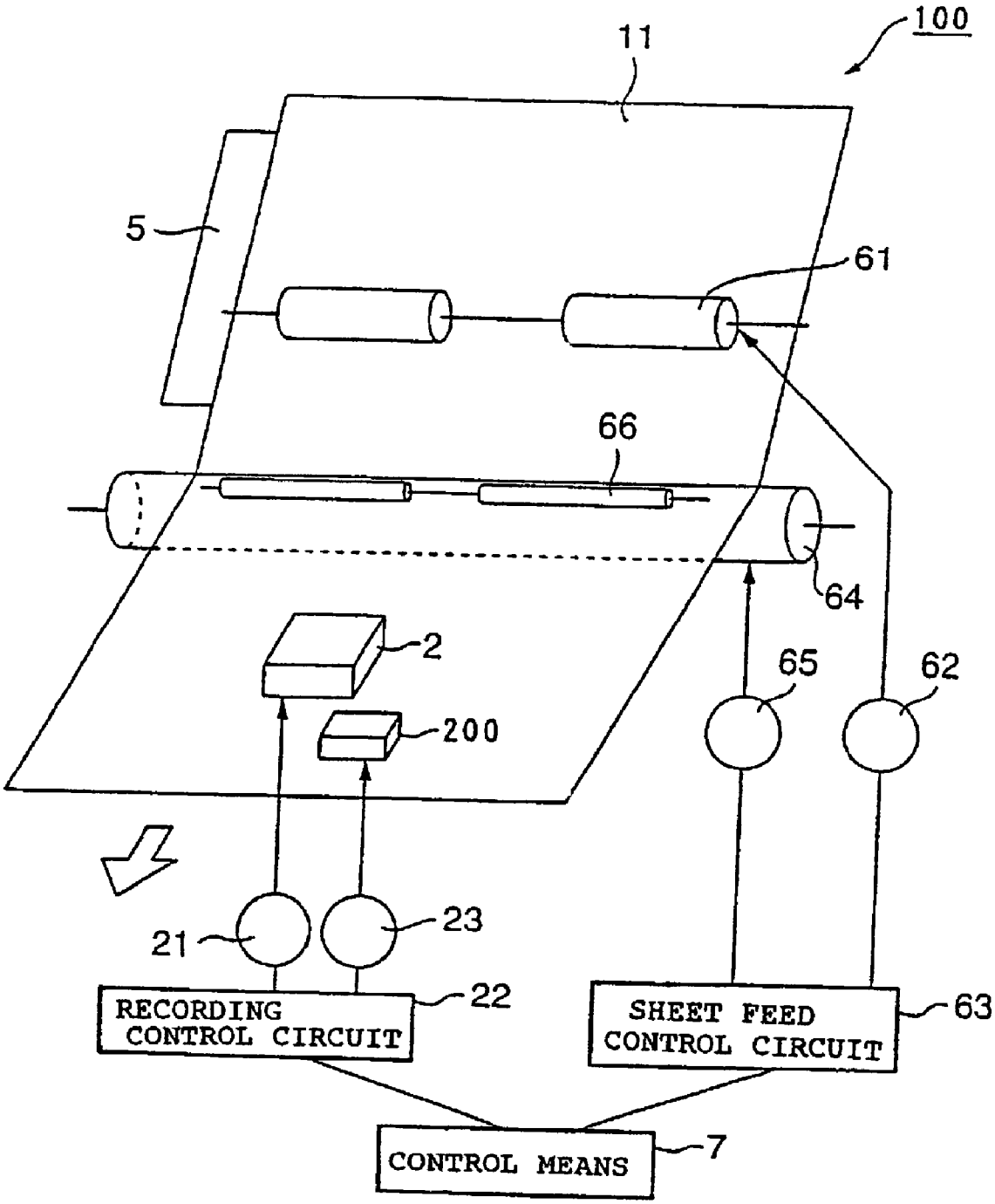
FIG. 3 is a hardware structural diagram of an ink jet printer used in an embodiment of the present invention.

In FIG. 3, the ink jet printer 100 comprises a printing mechanism and a control circuit.

The printing mechanism comprises a printer head 200, a printer head driving device 21 that drives this printer head 200, a wiping part 20, a wiping part driving device 23 that drives this wiping part 20, an edge guide 5, paper supply rollers 61, a paper supply motor 62 that drives these paper supply rollers 61, a paper feed roller 64, a paper feed motor 65 that drives this paper feed roller 64, and paper retainers 66.

The control circuit comprises a recording control circuit 22, a sheet feed control circuit 63, and control means 7.

The printer head 200 comprises an ink discharge part, an ink cartridge, a surface treatment agent discharge part, and a surface treatment agent cartridge. The surface treatment agent cartridge is caused to communicate with the surface treatment agent discharge part, and this surface treatment agent cartridge is filled with a surface treatment agent which contains oil and fat as the principal components of this treatment agent. The agents described above as examples are desirable as surface treatment agents, and the user replenishes the surface treatment agent in the surface treatment agent cartridge as required.

The edge guide 5 functions as a guide which is used to hold the recording medium 11, and to feed the recording medium 11 when the recording medium 11 is supplied to the printer head 200.

The paper supply rollers 61 and paper feed roller 64 cause the recording medium 11 to move toward the printer head 200. The paper retainers 66 are disposed so that the recording medium 11 is clamped between these paper retainers 66 and the paper feed roller 64.

The recording control circuit 22 is connected to the printer head 200 via the printer head driving device 21. The sheet feed control circuit 63 is connected to the paper supply rollers 61 via the paper supply motor 62, and the sheet feed control circuit 63 is also connected to the paper feed roller 64 via the paper feed motor 65. The control means 7 are connected to the recording control circuit 22 and sheet feed control circuit 63.

The printer head 200 performs recording on the recording medium 11 by causing ink particles to jet from a nozzle installed in the ink discharge part while moving at a high speed in the direction perpendicular to the paper feed direction on the basis of the output from the printer head driving device 21; furthermore, the printer head 200 also performs a treatment by blowing a surface treatment agent onto the recording medium 11 from a nozzle disposed in the surface treatment agent discharge part. The surface treatment agent is blown onto a position that is located after the abovementioned recording position in the direction of paper feed.

Besides the abovementioned blowing treatment, a spray treatment, coating treatment or immersion treatment is desirable as the method used to discharge the surface treatment agent from the surface treatment agent discharge part.

After images have been recorded on the recording medium 11, the wiping part 20 is driven on the basis of the output from the wiping part driving device 23. As a result, the excess surface treatment agent discharged onto the recording medium 11 is removed, and the luster can be adjusted or the durability increased by the rubbing of the surface of the recording medium 11.

Furthermore, the wiping part 20 may also be installed as an integral unit with the printer head 200.

By using an ink jet printer of the type described above, it is possible to obtain recorded matter in which the gas resistance and luster are improved.

[Surface Treatment Apparatus]

Next, [another] surface treatment apparatus constructed according to the present invention, and the operation of this surface treatment apparatus, will be described with reference to FIG. 4.

Figure 4:
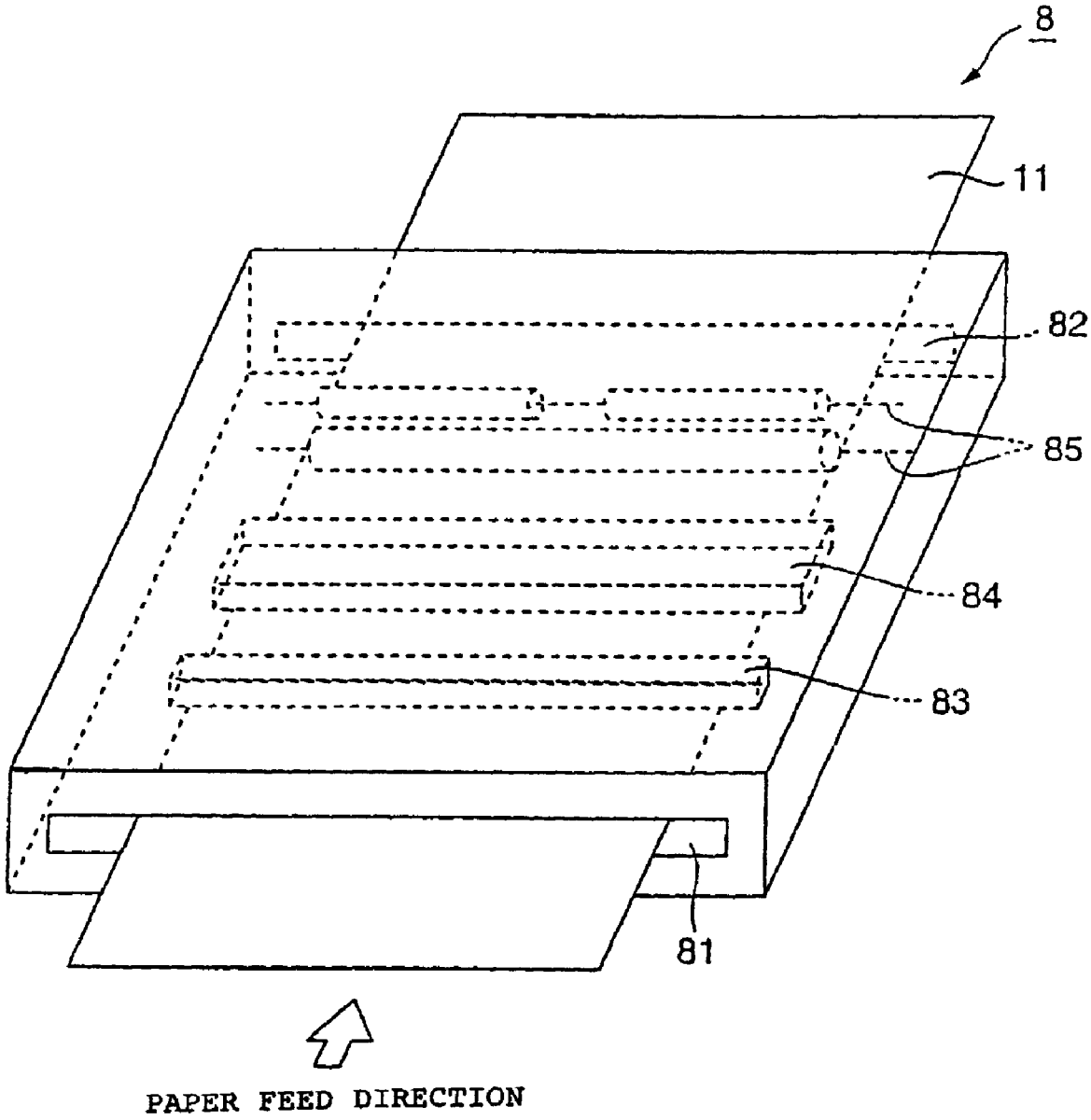
FIG. 4 is a transparent view of the interior of a surface treatment apparatus constituting an embodiment of the present invention.

In FIG. 4, the surface treatment apparatus 8 comprises a paper supply opening 81, a paper discharge opening 82, a surface treatment agent discharge part 83, a wiping part 84 and a paper feed part 85.

A surface treatment agent replenishment opening (not shown in the figures) which communicates with the surface treatment agent discharge part 83 is formed in the surface treatment apparatus 8, so that the user can appropriately replenish a surface treatment agent reservoir part (not shown in the figures) with a surface treatment agent containing oil and fat as the principal constituents of this treatment agent. It is desirable to use one of the treatment agents indicated as examples above as the surface treatment agent.

A surface treatment agent wiping part 84 is installed after the surface treatment agent discharge part 83 in the direction of paper feed.

The paper feed part 85 causes the recorded matter 11 to move in the paper feed direction by means of a pair of rollers.

The surface treatment apparatus 8 has driving means (not shown in the figures) for driving the surface treatment agent discharge part 83, wiping part 84 and paper feed part 85. The driving means may be either manual or controlled driving.

When the tip end of the recorded matter 11 is inserted into the paper supply opening 81, and abovementioned driving means are driven in a specified manner, a surface treatment agent containing oil and fat as the principal constituents of this agent is discharged as desired from the surface treatment agent discharge part 83, and the paper feed part 85 is driven as desired. As a result, the recorded area moves in the paper feed direction while the surface treatment agent is discharged onto the recorded matter 11. Next, as a result of the wiping part 84 being driven in a desired manner by the above-mentioned driving means, the excess surface treatment agent discharged onto the recorded matter 11 is removed, and the surface of the recorded matter 11 is rubbed. As a result, the luster of the recorded matter 11 is adjusted, and the durability of the recorded matter is improved. The recorded matter onto which the surface treatment agent has been discharged and from which the [excess] surface treatment agent has been wiped away is discharged from the paper discharge opening 82 by the driving of the paper feed part 85.

By using a surface treatment apparatus of the abovementioned type, it is possible to obtain recorded matter in which the gas resistance and luster are improved.

[Surface Treatment Kit]

Next, a surface treatment kit constructed according to the present invention will be described with reference to FIG. 5.

Figure 5:
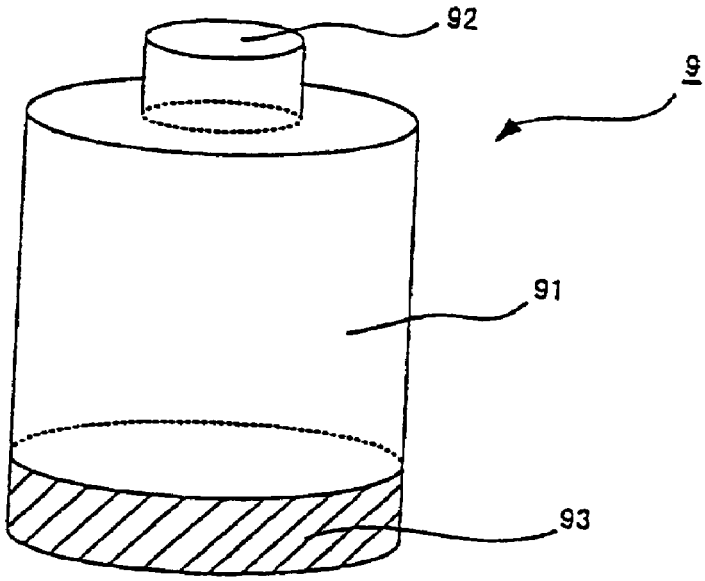
FIG. 5 is a model diagram of a surface treatment kit used in an embodiment of the present invention.

In FIG. 5, the surface treatment kit 9 comprises a main body 91 which accommodates the surface treatment agent, a sponge-form member 92 (coating means), and an elastic absorbing member 93 (wiping means). The sponge-form member 92 may also be a foam-form member.

A surface treatment agent replenishment opening (not shown in the figures) is formed in the main body 91, so that the user can appropriately replenish the main body 91 with a surface treatment agent containing oil and fat as the principal constituents of this agent. It is desirable to use one of the treatment agents indicated as examples above as the surface treatment agent.

After replenishing the main body with the surface treatment agent, the user holds the kit 9 with the sponge-form member 92 facing downward, and traces the entire surface of the recorded matter while causing the sponge-form member 92 to contact the surface of the recorded matter. As a result, the surface of the recorded matter is coated with an appropriate amount of the surface treatment agent inside the main body 91 via small holes in the sponge-form member 92. Next, the user holds the kit 9 with the elastic absorbing member 93 facing downward, and traces the entire surface of the recorded matter while causing the elastic absorbing member 93 to contact the surface of the recorded matter. As a result, the surface treatment agent that has been applied as a coating is spread more uniformly on the surface of the recorded matter, and is absorbed and wiped away by the elastic absorbing member 93.

Besides the above kit, it would also be possible to construct a roll-form surface treatment kit comprising a surface treatment agent coating roll and a wiping roll. Furthermore, a brush-form surface treatment kit in which the surface treatment agent is applied to the surface of the recorded matter and simultaneously wiped away by means of a brush-form member could also be constructed.

By using a surface treatment kit of the type described above, it is possible to obtain recorded matter in which the gas resistance and luster are improved.

(Surface Treatment Apparatus According to Seventh Embodiment)

Figure 6:
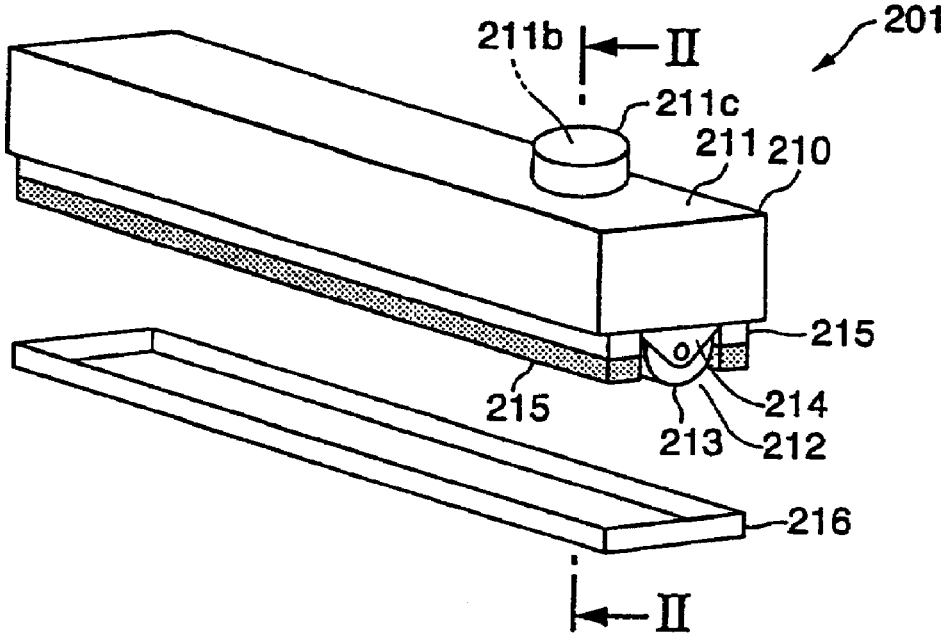
FIG. 6 is a perspective view showing an outline of a surface treatment kit used in an embodiment of the present invention.
Figure 7:
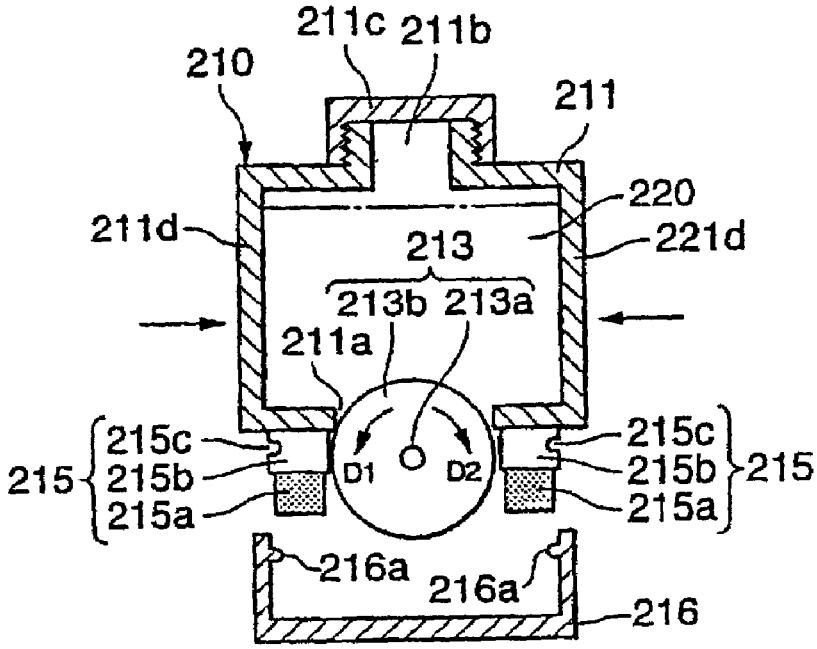
FIG. 7 is a sectional view along line II—II in FIG. 6.

Here, FIG. 6 is a perspective view which shows an outline of an embodiment of the surface treatment kit of the present invention, and FIG. 7 is a sectional view along line II—II in FIG. 6.

The surface treatment kit of the present invention is a surface treatment kit which treats the recorded surface of a recording medium on which recording is performed. In the case of this surface treatment kit, desired recording is performed on the recording medium by means of an ink jet system, after which the surface treatment kit is used to treat the recorded surface of the recording medium on which recording has been performed.

Here, as long as the surface treatment kit is equipped with treatment agent coating means (described later), this term "surface treatment kit" may be viewed as a concept which includes kits that are devised so that the kits are separately filled with a treatment agent, kits that are devised so that a plurality of members are used in different combinations, kits that are pre-filled with a treatment agent, and kits in which a plurality of members are formed into an integral unit or the like.

Furthermore, it goes without saying that character information and the like is included in recording in addition to photographs, drawings and the like.

Moreover, as is shown in FIGS. 6 and 7, the surface treatment kit of the present embodiment has surface treatment agent coating means for coating the abovementioned recorded surface with the treatment agent while making direct contact with this recorded surface.

This embodiment will be described more concretely below.

The surface treatment kit 201 of the present embodiment comprises a treatment agent coating device 210 which has a tank member 211 that accommodates the treatment agent and a coating head 212 that has treatment agent coating means 213, and a liquid-form treatment agent that is accommodated inside the treatment agent coating device 210. In the present embodiment, the treatment agent coating means 213 comprise a roller-form member 213.

In the present embodiment, the tank member 211 has a more or less rectangular solid shape, and has a rectangular opening 211*a* formed in the bottom of the tank member 211. This opening 211*a* is devised so that the inside edge of the opening contacts the outer circumferential surface of the roller-form member 213 used as the abovementioned treatment agent coating means 213, thus preventing the treatment agent contained inside from leaking out.

A replenishment opening 211*b* used to replenish the treatment agent is formed in the tank member 211. This replenishment opening 211*b* is cylindrical, and is formed in the upper part of the tank member 211. Furthermore, a replenishment opening cap 211*c* is screwed onto the replenishment opening 211*b* so that this cap can be removed.

The coating head 212 is formed on the bottom side of the tank member 211, and comprises the roller-form member 213 used as the abovementioned treatment agent coating means 213, holding parts 214 which hold the roller-form member so that the roller-form member is free to rotate, and wiping means 215 comprising elastic members 215*a* for wiping away and removing the excess portion of the treatment agent that is applied as a coating to the abovementioned recorded surface.

The roller-form member 213 comprises a central shaft 213*a* and a roller main body 213*b*, and has a cylindrical shape overall.

The holding parts 214 are disposed on both end parts (with respect to the direction of length) at the bottom of the tank member 211, so that these holding parts 214 support the central shaft 213*a* of the roller-form member 213. The holding parts 214 have a substantially triangular shape, and the central shaft 213*a* is held in the tip end portions of the holding parts 214 so that the shaft is free to rotate.

The wiping means 215 comprise elastic members 215*a*, and elastic member holding members 215*b* which hold the elastic members 215*a*. The elastic member holding members 215*b* are substantially rectangular frame bodies, and the elastic members 215*a* are inserted into these frame bodies. Furthermore, since the elastic members 215*a* have dimensions that are slightly larger than the internal dimensions of the elastic member holding members 215*b*, the elastic members 215*a* are inserted into the elastic member holding members 215*b* in a slightly compressed state, and are thus held so that the elastic members 215*a* are prevented from falling.

Furthermore, it is desirable that the wiping means 215 be installed so that the means are positioned after the roller-form member 213 (with respect to the direction of rotation). In the present embodiment, the roller-form member 213 can rotate in either of rotational directions D1 and D2 in FIG. 7; accordingly, the wiping means 215 are installed on both outer sides of the roller-form member 213 (with respect to the direction of diameter), so that wiping means 215 are positioned after the roller-form member 213 with respect to the direction of rotation regardless of the rotational direction of roller-form member 213.

Furthermore, a cap member 216 which protects the coating head 212 is detachably attached to the coating head 212. In the present embodiment, the cap member 216 is a box-form body with a rectangular solid shape in which the entire upper surface is formed as an opening, and protruding parts 216*a* are formed on the opening sides of the wall parts along the direction of length of the cap member 216 so that these protruding parts engage with recessed parts 215*c* formed in the surfaces of the elastic member holding members 215*b* located on the outside of the tank member 211.

The surface treatment kit 201 of the present embodiment has coating amount adjustment means for adjusting the coating amount of the treatment agent from the treatment agent coating means 213. In concrete terms, the coating amount adjustment means is formed in the present embodiment by constructing the wall parts 211*d* of the tank member 211 so that these wall parts possess an elastic force. Since the wall parts 211*d* are formed so that these wall parts have an elastic force, the wall parts 211*d* can be indented in the directions indicated by the arrows in FIG. 7 by pressing these wall parts 211*d* in the directions indicated by the arrows in FIG. 7. As a result, the pressure inside the tank member becomes higher than the contact pressure between the opening 211*a* and the roller main body 213*b*, so that the treatment agent can be squeezed out from the area of contact between the opening 211*a* and the roller main body 213*b*. In this way, the coating amount can be adjusted. Here, methods used in ordinary containers and the like can be used without any particular restrictions in order to endow the wall parts 211*d* of the tank member 211 with an elastic force. In concrete terms, these wall parts 211*d* can be endowed with an elastic force by using a material with a high elastic force as the material that forms the tank member 211, or by adjusting the thickness and height of the wall parts 211*d* of the tank member 211.

Next, desirable materials for forming the respective members described above will be described.

In the surface treatment kit of the present embodiment, the elastic members 215*a* consist of sponge-form members; examples of the material of such sponge-form members include cotton, polyurethanes and natural sponge.

Furthermore, it is desirable that the roller main body 213*b* in the roller-form member 213 be constructed so that contact with the opening 211*a* provides a sufficient seal to prevent leakage of the contents, and so that there is no interference with the rotational characteristics of the roller.

In the present invention, the treatment agents described in the abovementioned first through fourth embodiments are desirable for use as the treatment agent.

It is desirable that the abovementioned tank member be formed from a material that is insoluble with respect to the abovementioned treatment agent. Here, universally known materials such as metals, plastics and the like may be used without restriction as such insoluble materials. Examples of plastics that can be used include polypropylenes, polyethylene terephthalates and the like.

Furthermore, the surface treatment kit of the present embodiment can be used by applying the treatment agent as a coating and removing the excess treatment agent, this operation being accomplished by releasing the protruding parts 216*a* engaged with the recessed parts 215*c* and removing the cap member 216 so that the coating head 212 is exposed, and then causing the roller-form member 213 and wiping means 215 to contact the recorded surface of the recording medium directly while adjusting the coating amount by pressing the wall parts 211*d*.

Since the surface treatment kit of the present embodiment is constructed as described above, a treatment for the purpose of protecting images formed by an ink jet system can be performed easily and safely.

In particular, as a result of the provision of wiping means as in the present embodiment, the appropriate amount of treatment agent can easily be applied as a coating by anyone, so that an unskilled user can easily use this surface treatment kit to perform a surface treatment in the household.

Furthermore, in cases where the surface treatment kit has a tank member 211 and coating head 212 constructed as described above, the provision of a replenishment opening 211*b* allows repeated use. Moreover, since a cap member 216 is provided, evaporation of the treatment agent can be prevented, and application of the treatment agent to unnecessary places can be prevented. As a result, this surface treatment kit is superior in terms of cost performance, and the safety of the kit is also improved.

Furthermore, the surface treatment method of the present invention can also be performed by performing desired recording on a recording medium using an ink jet system, and then using the abovementioned surface treatment kit to apply the treatment agent as a coating to the recorded surface of the recording medium on which recording has been performed.

The surface treatment method of the present invention makes it possible to treat the abovementioned recorded surface easily and safely.

Furthermore, the recorded matter of the present invention is recorded matter in which desired recording is performed on a recording medium using an ink jet system, after which the abovementioned treatment agent is applied as a coating to the recorded surface of the recording medium on which recording has been performed.

Furthermore, in the recorded matter of the present invention, since the recorded surface is surface-treated by means of the abovementioned treatment agent, recorded matter in which recording has been performed using a pigment ink is superior in terms of light resistance and gas resistance. Moreover, recorded matter in which recording has been performed using a dye ink is superior in terms of friction resistance and sensation of luster.

(Surface Treatment Apparatus According to Eighth Embodiment)

Figure 8:
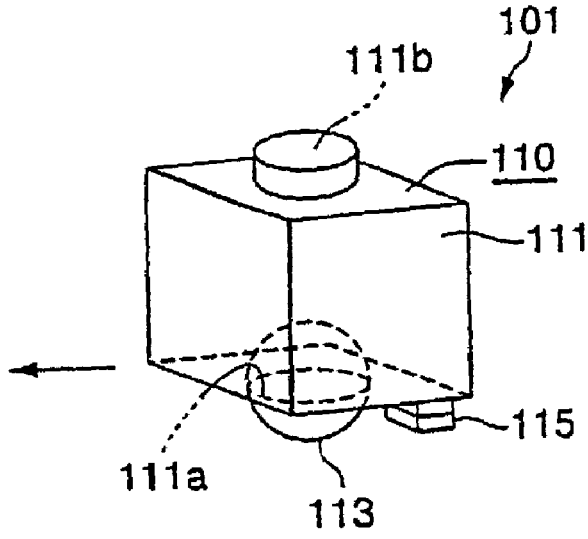
FIG. 8 is an interior transparent perspective view showing essential parts of a [blank] embodiment.

Next, an eighth embodiment of the present invention will be described. FIG. 8 is a transparent perspective view which shows the essential parts of this eighth embodiment. Furthermore, the following description will center on points that differ from the abovementioned seventh embodiment. In the case of points that are not specifically described, the description given in the abovementioned seventh embodiment may be appropriately applied.

In the surface treatment kit 101 of the eighth embodiment of the present invention, as is shown in FIG. 8, the treatment agent coating means 113 comprise a ball-form member 113. Furthermore, the shape of the tank member 111 is more or less cubic, and the opening 111*a* is round. Furthermore, wiping means 115 are installed only on one side edge of the tank member, and the desirable direction for performing a surface treatment is limited to the direction indicated by the arrow in FIG. 3.

Except for these points, this surface treatment kit is identical to the surface treatment kit of the seventh embodiment.

In the present embodiment, only the portion of the ball-form member used as the treatment agent coating means 113 that is located below the center of the ball-form member is exposed beneath the opening 111*a* of the tank member 111. Furthermore, the ball-form member is attached in a state that allows free rotation of this member; as a result, the gap between the ball-form member and the opening 111*a* is sealed so that the treatment agent inside the tank member cannot leak out.

The material used to form the ball-form member may be the same as the material used to form the abovementioned roller-form member.

Furthermore, the present invention is not limited to the abovementioned embodiment; various alterations are possible within limits that involve no departure from the gist of the present invention.

For example, as long as treatment agent coating means are provided in a state that allows application of the treatment agent as a coating, the wiping means and tank member may be omitted, and the apparatus may be constructed from only treatment agent coating means consisting of a sponge-from member impregnated with the treatment agent.

(Surface Treatment Apparatus According to Ninth Embodiment)

It is desirable that the two or more different types of recording medium treatment agents used in the present embodiment be [at least] a luster-imparting liquid and a matte finishing treatment liquid; in addition, however, other treatment agents such as a treatment agent for silk paper or a treatment agent for semi-glossy paper may also be used.

The term "luster-imparting liquid" refers to a liquid which contains a substance that can impart luster to the recording medium as an active constituent, while the term "matte finishing treatment liquid" refers to a treatment liquid which contains a substance that can form a matte finish on the recording medium (i.e., a substance that can lower the luster of the recording medium) as an active constituent.

Such luster-imparting liquids contain a substance that is capable of imparting luster as an essential active constituent; for example, it is desirable that such liquids contain a water-soluble resin component, emulsion, latex or the like as an essential active constituent.

Matte finishing treatment liquids contain a substance that is capable of performing a matte finishing treatment as an essential active constituent; for example, it is desirable that such liquids contain silica, colloidal silica, a plastic pigment, an emulsion or the like as an essential active constituent.

Solvents which can be appropriately used in luster-imparting liquids and matte finishing treatment liquids include water, water-soluble organic solvents and mixtures of water and such solvents. In luster-imparting liquids and matte finishing treatment liquids, it is desirable that the mixture proportions (weight ratio) of the abovementioned active constituents and solvents be as follows: active constituent solvent=1:10~1:100.

Since the treatment agent is an agent that performs a desired treatment by being discharged from an ink jet head in the same manner as ink, it is desirable that the treatment agent have physical properties similar to the physical properties of inks in order to insure a discharge stability and storage stability similar to those of inks. In concrete terms, it is desirable that the viscosity be in the range of 1 to 40 mPa×s, and that the surface tension be in the range of 15 to 50 mN/m.

Furthermore, water resistance improving agents, light resistance improving agents, gas resistance improving agents, friction resistance improving agents, anti-oxidants, ultraviolet absorbing agents, radical absorbing agents, film formation improving agents, preservatives, antimicrobial agents, leveling agents and the like may also be added to the treatment agent.

Agents similar to those described in the first embodiment are used as light resistance improving agents.

Common anti-oxidants can be used without any particular restrictions as the abovementioned anti-oxidants. In concrete terms, agents similar to the oil-soluble anti-oxidants that can be used in the abovementioned third embodiment are suitable for use. Furthermore, anti-oxidants may be used singly or in mixtures consisting of two or more anti-oxidants.

Common ultraviolet absorbing agents can be used without any particular restrictions; in concrete terms, agents similar to the oil-soluble ultraviolet absorbing agents that can be used in the abovementioned third embodiment are suitable for use. Furthermore, organic ultraviolet absorbing agents such as 4-bis(polyethoxy)-p-aminobenzoic acid polyethoxyethyl ethers, macromolecular 2-(2'-hydroxy-5'-methacryloxyphenyl)-2H-benzotriazole and emulsion type macromolecular ultraviolet absorbing agents or the like, and inorganic ultraviolet absorbing agents such as titanium oxide, zinc oxide and cerium oxide or the like are desirable.

Furthermore, any resin that can form a resin film that is capable of manifesting water resistance and friction resistance may be used as the abovementioned resin that has a film forming function; thermoplastic resins are especially desirable for use. Examples of thermoplastic resins that can be used include polyacrylic acids, polymethacrylic acid esters, polyethylacrylic acids, styrene-butadiene copolymers, polybutadienes, acrylonitrile-butadiene copolymers, chloroprene copolymers, fluoro-resins, vinylidene chloride, polyolefin resins, cellulose, styrene-acrylic acid copolymers, styrene-methacrylic acid copolymers, polystyrenes, styrene-acrylamide copolymers, polyisobutyl acrylates, polyacrylonitriles, polyvinyl acetates, polyvinylacetals, polyamides, rosin type resins, polyethylenes, polycarbonates, vinylidene chloride resins, cellulose type resins, vinyl acetate resins, ethylene-vinyl acetate copolymers, vinyl acetate-acrylic copolymers, vinyl chloride resins, polyurethanes, rosin esters, polyethylene wax, montan wax, alcohol wax, synthetic oxidized wax, α-olefin-maleic anhydride copolymers, carnauba wax, lanolin, paraffin wax, microcrystalline wax and the like. These compounds may be used singly or in mixtures consisting of two or more compounds.

Any compounds capable of quenching generated radicals may be used as radical absorbing agents. For example, hindered amine type compounds are desirable for use. Examples of hindered amine type compounds include 4-benzoyloxy-2,2,6,6-tetramethylpiperidine, bis-2,2,6,6-tetramethyl-4-piperidyl) malonate, bis-(2,2,6,6-tetramethyl-4-piperidyl) phthalate, 2,2,6,6-tetramethyl-4-piperidyl benzoate, 4-amino-2,2,6,6-tetramethylpiperidine, 2,2,6,6-tetramethyl-4-piperidyl sebacate, bis-(2,2,6,6-tetramethyl-4-methylpiperidyl) sebacate, di-(1,2,2,6,6-pentamethyl-4-piperidyl)-2-n-butyl-2-(3,5-t-butyl-4-hydroyxbenzyl) malonate, bis(2,2,6,6-tetramethyl-4-carbonyloxypiperidino)-p-dimethylbenzil, 2,2,4,4-tetramethyl-7-oxa-3,20-diaza-21-oxo-dispiro[5.1.9.19]heneicon, bis-(2,2,6,6-tetramethyl-4-piperidinyl) sebacate, dimethyl succinate, 2-(4-hydroxy-2,2,6-6-tetramethyl-1-piperidinyl)ethanol condensate, [(6-(1,1,3,3-tetramethylbutyl)imino)-1,3,5-triazine-2,4-diyl-(4-(2,2,6,6-tetramethylpiperidinyl)imino)-hexamethylene-(4-(2,2,6,6-tetramethylpiperidinyl)imino)] and the like. These compounds may be used singly or in mixtures consisting of two or more compounds.

Furthermore, the treatment agent used in the present invention can be prepared by dissolving or dispersing the above-mentioned essential active constituents and the abovementioned active constituents in the abovementioned solvents using universally known methods without any particular restrictions.

Furthermore, a surface treatment apparatus equipped with the abovementioned treatment agent cartridge or ink cartridge may be installed separately from the printer. This surface treatment apparatus may be equipped with control means for determining which of the two or more different types of treatment agents is to be discharged onto the recorded surface; alternatively, the apparatus may be constructed so that the treatment agents that are discharged are switched manually. Furthermore, this surface treatment apparatus may be a surface treatment kit which is equipped with the abovementioned treatment agent cartridge or ink cartridge.

Figure 9:
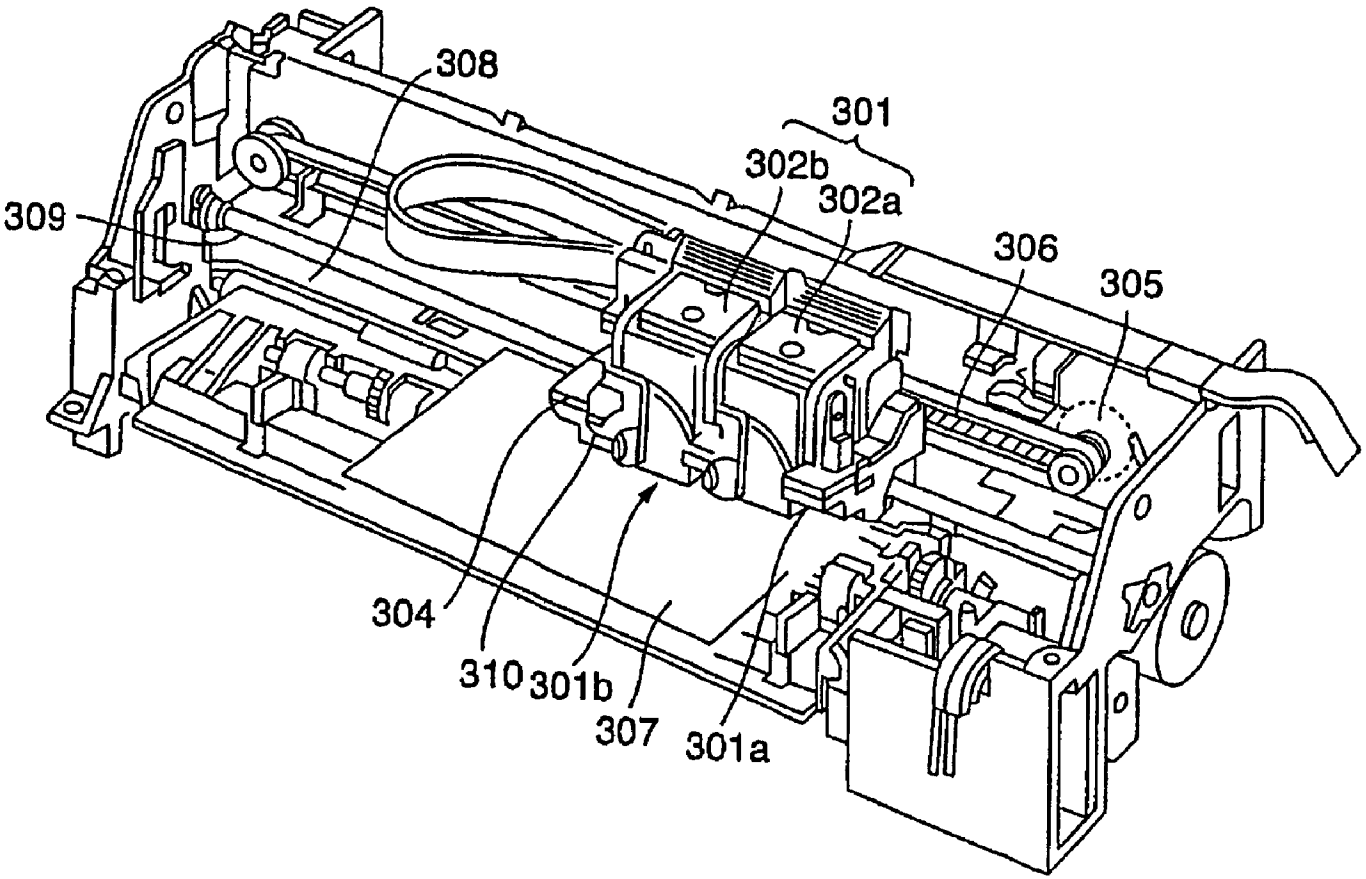
FIG. 9 is a perspective view of the head part constituting an essential part of the printer of the present invention.
Figure 10:
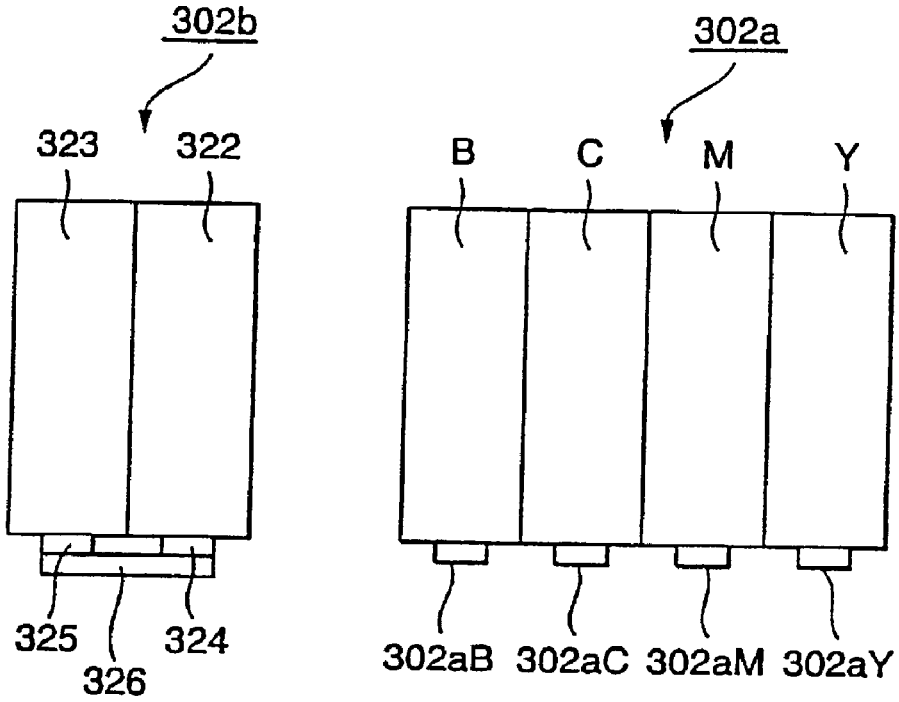
FIG. 10 is an explanatory diagram of the ink cartridge and treatment agent cartridge of the present invention shown in FIG. 9.

Here, FIG. 9 is a perspective view of the head part which constitutes an essential part of the printer of the present invention. Furthermore, FIG. 10 is an explanatory diagram of the ink cartridge and treatment agent cartridge of the present invention shown in FIG. 9.

As is shown in FIG. 9, the recording head part 301 in the printer of the present embodiment comprises an ink discharge port 301*a* and treatment agent discharge port 301*b*, an ink cartridge 302*a* and treatment agent cartridge 302*b* which are connected with the respective discharge ports in a state that allows fluid communication, a carriage 304 to which the respective cartridges are attached, a timing belt 306 which causes the carriage 304 to move, and a motor 305 which drives the timing belt 306.

The respective discharge ports 301*a* and 301*b* are formed in the carriage 304, and the carriage 304 is constructed so that these discharge ports 301*a* and 301*b* and the respective cartridges 302*a* and 302*b* can be carried in a state of fluid communication. The recording medium 307 is moved by means of a platen 308 and guide 309 so that the area where recording is to be performed is positioned in a position facing the recording head 301. A detection part 310 comprising a sensor body that detects reflected light on the basis of differences in the reflectivity of the recording medium is also disposed on the carriage 304.

In the ink cartridge 302*a* used in the present embodiment, four ink compartments Y, M, C and B that accommodate respective yellow, magenta, cyan and black inks are disposed in a row. Furthermore, the respective ink compartments include respective ink supply ports 302*a*Y, 302*a*M, 302*a*C and 302*a*B that lead from the respective ink compartments to the ink discharge port 301*a*.

The treatment agent cartridge 302*b* includes respective treatment agent compartments 22 and 23 that accommodate a luster-imparting liquid and a matte treatment finishing liquid, respective treatment agent supply ports 324 and 325 that lead from the respective treatment agent compartments to the treatment agent discharge port 301*b*, and a valve 326 that controls the fluid communication between the respective treatment agent supply ports and the treatment agent discharge port 301*b*.

An example in which recorded matter is manufactured by the ink jet method using the printer of the present embodiment will be described below.

First, the recording medium 307 is set in the paper supply means (not shown in the figures), and a recording start signal is sent from specified control means (not shown in the figures) such as a personal computer or the like. The recording medium 307 is caused to move to a position facing the recording head 301 by the platen 308 and guide 309. Here, the detection part 310 of the recording head 301 detects the type of the recording medium 307. The valve 326 is actuated by the output from the control means on the basis of the type of recording medium 307 that is detected by the detection part 310, so that either the luster-imparting liquid compartment 322 or matte finishing treatment liquid compartment 323 accommodated inside the treatment agent cartridge 302*b* is conducted to the treatment agent discharge port 301*b*. Meanwhile, inks of the desired colors are discharged onto the recording medium 307 from the ink discharge port 301*a* on the basis of recording signals sent from a personal computer or the like, so that a recorded surface is formed on the recording medium 307. The desired treatment agent selected on the basis of the operation of the detection part 310 is discharged from the treatment agent discharge port 301*b* onto the recording medium 307 on which a recorded surface has thus been formed, so that a protective layer that protects the recorded surface is formed on the recording medium 307.

Here, the discharge of the treatment agent may be performed over the entire surface of the recording medium, or the treatment agent may be selectively discharged only on the portions coated by ink as a result of the discharge of ink from the printer head 321.

Furthermore, it is desirable that the treatment agent be discharged so that a resolution of 360 dpi to 1440 dpi is obtained. Moreover, it is desirable that this discharge be performed so that the amount of the treatment agent that is discharged is 1 pl to 40 pl.

In the abovementioned treatment method, recorded matter with an appropriate recorded surface protective effect, e.g., recorded matter endowed with luster, matte finishing treatment water resistance, light resistance, friction resistance, gas resistance and the like, can be obtained by selecting and discharging an appropriate treatment agent in accordance with the type of recording medium used.

(Surface Treatment Apparatus According to Tenth Embodiment)

Figure 11:
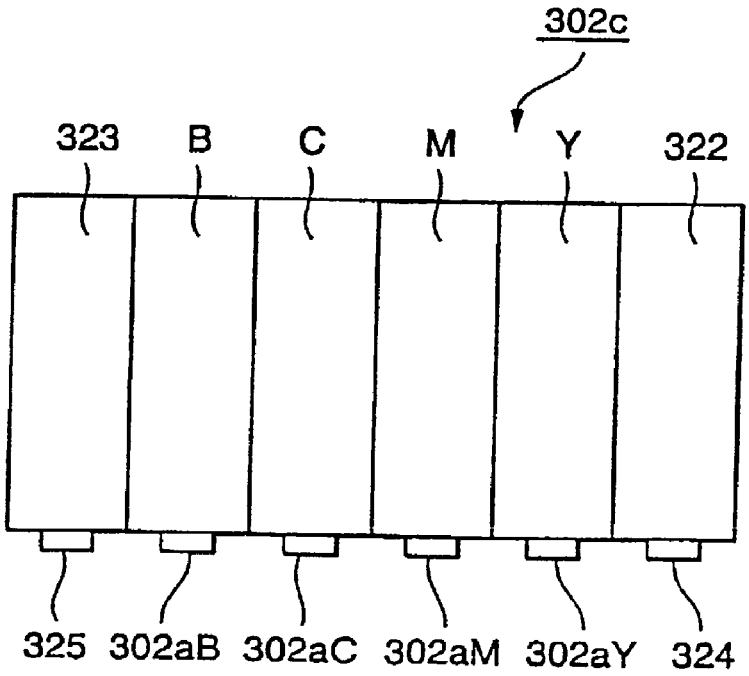
FIG. 11 is an explanatory diagram of an ink cartridge used in an embodiment of the present invention.

The present embodiment differs from the abovementioned ninth embodiment only in that this embodiment is equipped with an ink cartridge of the type shown in FIG. 11 instead of the [cartridges used in] the abovementioned ninth embodiment. FIG. 11 is an explanatory diagram which illustrates the ink cartridge used in the present embodiment.

The present embodiment differs from the abovementioned ninth embodiment in that ink compartments and treatment agent compartments are installed as an integral unit in a single ink cartridge. Specifically, in the ink cartridge 302*c*, ink compartments Y, M, C and B that accommodate respective yellow, magenta, cyan and black inks, a treatment agent compartment 322 that accommodates a luster-imparting liquid, and a treatment agent compartment 323 that accommodates a matte finishing treatment liquid, are lined up in a row. Furthermore, the arrangement of the treatment agent compartments 322 and 323 and the respective ink compartments may be appropriately interchanged.

In the present embodiment, as in the above-mentioned embodiments, recorded matter endowed with an optimal recorded surface protective effect can be obtained by selecting and discharging an appropriate treatment agent in accordance with the type of recording medium used.

(Surface Treatment Apparatus According to Eleventh Embodiment)

Figure 12:
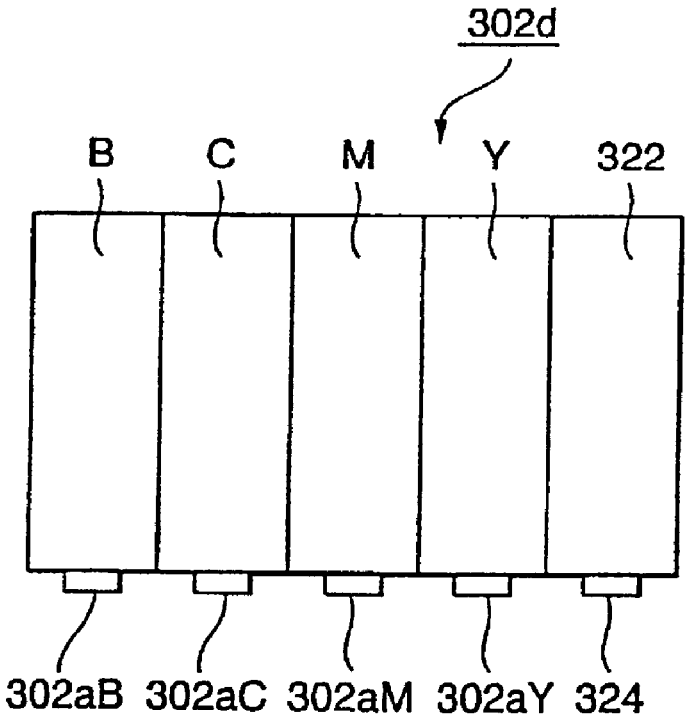
FIG. 12 is an explanatory diagram of an ink cartridge used in an embodiment of the present invention.
Figure 12:
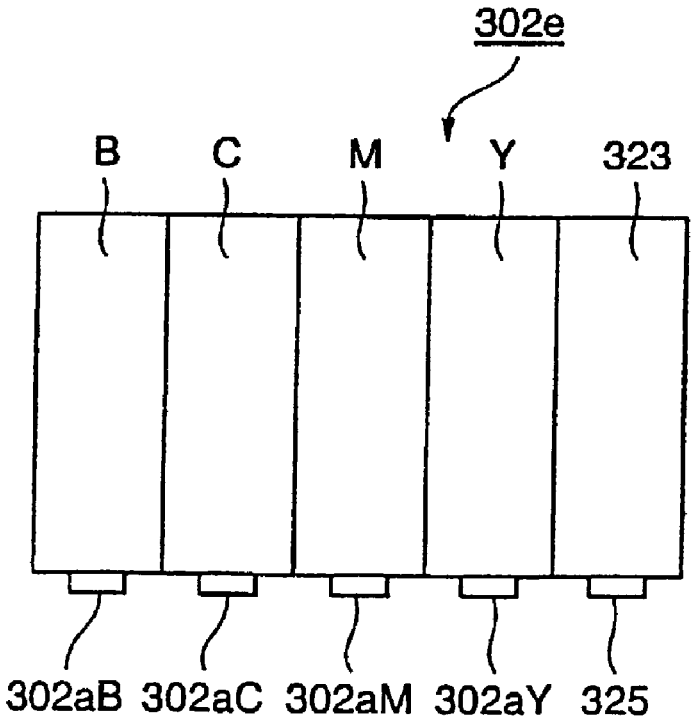

The present embodiment differs from the abovementioned ninth embodiment only in that this embodiment is equipped with ink cartridges of the types shown in FIG. 12 instead of the [cartridges used in] the abovementioned ninth embodiment. FIG. 12 is an explanatory diagram which illustrates the ink cartridge used in the present embodiment.

The present embodiment differs from the abovementioned ninth embodiment in that this embodiment uses a construction in which respective ink compartments and a treatment agent compartment 322 that accommodates a luster-imparting liquid are installed as an integral unit in an ink cartridge 302*d*, respective ink compartments and a treatment agent compartment 323 that accommodates a matte finishing treatment liquid are installed as an integral unit in an ink cartridge 302*e*, and both of these cartridges 302*d* and 302*e* are attached to a carriage. Furthermore, the disposition of the treatment agent compartments and ink compartments in 302*d* and 302*e* may be appropriately interchanged.

In the present embodiment, as in the above-mentioned embodiments, recorded matter which is endowed with an optimal recorded surface protective effect can be obtained by selecting and discharging an appropriate treatment agent in accordance with the type of recording medium used.

(Surface Treatment Apparatus According to Twelfth Embodiment)

Figure 13:
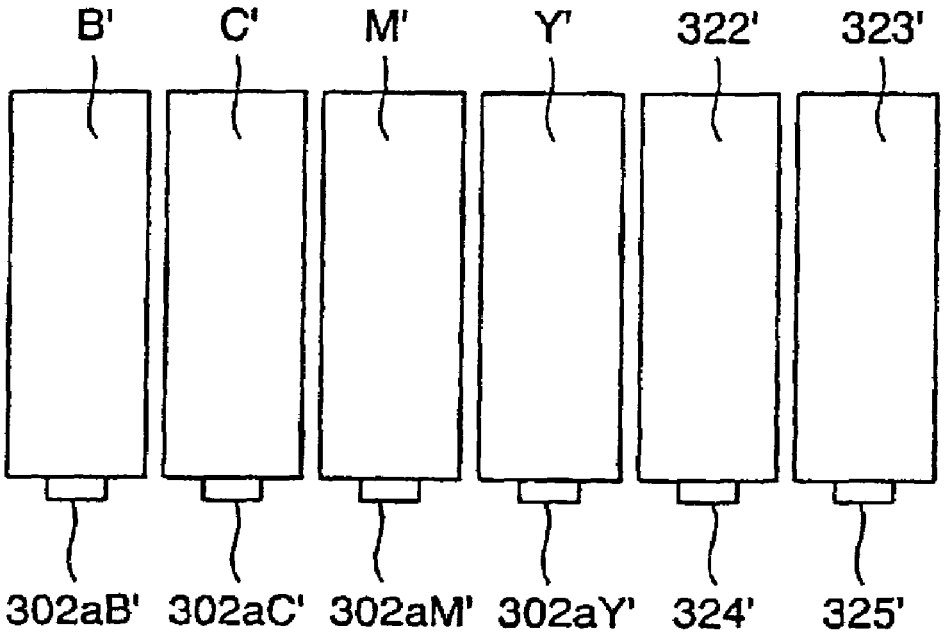
FIG. 13 is an explanatory diagram of an ink cartridge and treatment agent cartridge used in an embodiment of the present invention.

The present embodiment differs from the abovementioned ninth embodiment only in that this embodiment is equipped with ink cartridges of the types shown in FIG. 13 instead of [the cartridges used in] the abovementioned ninth embodiment. FIG. 13 is an explanatory diagram which illustrates the ink cartridges B', C', M' and Y' and the treatment agent cartridges 322' and 323' used in the present embodiment.

The present embodiment differs from the abovementioned first embodiment in that the respective cartridges are installed independently. Furthermore, the disposition of the respective cartridges may be appropriately interchanged.

In the present embodiment, as in the abovementioned embodiments, recorded matter endowed with an optimal recorded surface protective effect can be obtained by selecting and discharging an appropriate treatment agent in accordance with the type of recording medium used.

Furthermore, the present invention is not limited in any way to the abovementioned embodiments; various modifications are possible within limits that involve no departure from the gist of the present invention.

For example, the ink discharge port 301*a* and ink cartridge 302*s* are shown as being positioned on the left side in FIG. 9, and the treatment agent discharge port 301*b* and treatment agent cartridge 302*b* are shown as being positioned on the right side in FIG. 9; however, this positional relationship may also be reversed.

Furthermore, the ink cartridge 302*a* and treatment agent cartridge 302*b* are installed as separate parts; however, it would also be possible to use an integrated structure in which the respective ink accommodating compartments and respective treatment agent accommodating compartments are installed inside an integrated cartridge.

Moreover, the detection part 310 is installed on the carriage 304; however, it would also be possible to install this detection part 310 in an appropriate location on the recording head part of the printer. Furthermore, the detection part was described as consisting of a sensor body; however, it would also be possible to construct this detection part as a reading member that reads information such as bar codes or the like, or to use a construction in which a sensor body and a reading member are combined. In this case, it is necessary to form a display on the recording medium for the transmission of information such as bar codes or the like.

Furthermore, it would also be possible to install three treatment agent compartments in the treatment agent cartridge, and to accommodate a luster-imparting liquid, a matte finishing treatment liquid and some other treatment agent in these respective compartments. Moreover, it would also be possible to combine the treatment agents accommodated in two treatment agent compartments, using a combination of a luster-imparting liquid with another treatment agent, or a combination of a matte finishing treatment liquid with another treatment agent.

EXAMPLES

Next, the present invention will be concretely described in terms of examples; however, the present invention is not limited in any way by these examples. Furthermore, unless otherwise indicated, all "%" signs refer to "wt %"

Examples 1~23

Recorded matter for evaluation (beta printing of Y (yellow), M (magenta) and C (cyan) with an optical density of 1.0) consisting of color patches, portrait images and the like was formed on an ink jet recording medium (PM photographic paper manufactured by Seiko-Epson K.K.) using a commercially marketed ink jet printer (PM-800C manufactured by Seiko-Epson K.K.). The recorded matter immediately following recording showed good images in all cases. The surface of this recorded matter was subjected to the after-treatments shown in Table 1 using the treatment agents shown in Table 1, thus producing surface-treated recorded matter (a surface-treated product).

Comparative Example 1

Recorded matter obtained in the same manner as in the examples was evaluated without being surface-treated by an after-treatment.

(Evaluation of Light Resistance (Accelerated Test Using Xenon Lamp))

The abovementioned samples of surface-treated recorded matter were subjected to a 30 kJ/m$^2$ exposure test at a black panel temperature of 35° C., a relative humidity of 60% and an ultraviolet irradiation intensity of 0.18 W/m$^2$ at 340 nm using a xenon weather-o-meter (Ci-5000 manufactured by ATLAS Co.). Next, the residual percentage (%) of the optical density following the exposure test was determined by measuring the optical density of the recorded matter before and after the exposure test using a spectrophotometer (GRETAG SPM50 manufactured by Gretag-MacBeth Co.), and the light resistance was evaluated according to the following evaluation criteria:

A: Residual percentage of optical density exceeding 90%.
B: Residual percentage of optical density exceeding 80% but less than 90%.
C: Residual percentage of optical density exceeding 70% but less than 80%.
D: Residual percentage of optical density less than 70%.

The abovementioned samples of surface-treated recorded matter were subjected to a 72-hour exposure test using a simple type gas generator ($O_3$, $NO_2$, $SO_2$), with the respective gases being mixed at concentrations of approximately 1 ppm. Next, the optical density was measured in the same manner as in the case of the abovementioned evaluation of the light resistance, and an evaluation was performed using similar evaluation criteria.

The results obtained are shown in Table 1.

TABLE 1

| After-treatment (treatment method) | Treatment agent (materials) | Effect: Light resistance Y | Light resistance M | Light resistance C | Mixed gas ($O_3$, $NO_2$, $SO_2$) Y | Mixed gas M | Mixed gas C |
|---|---|---|---|---|---|---|---|
| Example | | | | | | | |
| 1 Spray treatment | Lacquer Spray EXE manufactured by Nippe Home Products K.K. *1 (100) | B | B | A | A | A | A |
| 2 | Daburo Special manufactured by Kusakabe K.K. *2 (100) | A | A | A | A | A | A |
| 3 | Gosei Jushi Toryo manufactured by Atomics K.K. *3 (100) | A | A | A | A | A | A |
| 4 Blowing treatment | PAS-H-SL manufactured by Nitto Boseki K.K. (10), water (90) | C | B | A | A | B | B |
| 5 | Toluene (100) | C | B | A | A | B | A |
| 6 | Water (100) | C | B | A | A | A | A |
| 7 | Sodium thiocyanate (10), water (90) | B | A | A | A | B | A |
| 8 Coating treatment (using sponge) | Nikkahibitor S-220 manufactured by Senka K.K. (10), Water (90) | A | C | A | A | B | A |
| 9 | Suprafix DFC manufactured by Senka K.K. (100) | B | A | A | A | B | A |
| 10 | Water-based varnish manufactured by Washin Paint K.K. *4 (100) | A | B | A | A | A | A |
| 11 | IRGANOX PS800FL manufactured by Ciba-Geigy Co. (10), toluene (45), methyl ethyl ketone (45) | B | B | A | A | B | A |
| 12 | STEEP1 Spray Wax manufactured by Suzuka Fine K.K. *5 (100) | B | B | A | A | A | A |
| 13 | Silicone Oil X-11-1618 manufactured by Shin'etsu Kagaku Kogyo K.K. | B | B | A | A | B | A |
| 14 Immersion treatment | PAS-H-5L manufactured by Nitto Boseki K.K. (10), water (90) | C | B | A | A | B | B |
| 15 | Xylene (100) | C | B | A | A | B | B |
| 16 | Water (100) | C | B | A | A | A | A |
| 17 | Thiosulfuric acid (2), water (98) | B | B | A | A | B | A |
| 18 | Ammonium thiocyanate (2), water (98) | B | A | A | A | B | A |
| 19 | Thiourea (2), water (98) | B | B | A | A | B | A |
| 20 | Isopropyl alcohol (100) | C | B | A | A | B | B |
| 21 | Cysteine (2), water (98) | C | A | A | A | A | A |
| 22 Treatment using | Water (100) | C | B | A | A | A | A |
| 23 ink jet recording head | PAS-H-5L manufactured by Nitto Boseki K.K. (10), water (90) | C | B | A | A | B | B |
| Comparative Example | | | | | | | |
| None (untreated) | — | C | B | A | A | C | D |

Furthermore, the numerals noted following the materials in the table indicate compostion ratios (wt %).
*1: Nitrocellulose, thermosetting resin, toluene
*2: Phenol resin, mineral spirit
*3: Acrylic resin, dimethyl ether
*4: Acrylic resin, water
*5: Fluoro-resin, fourth petroleum type As is clear from the results in Table 1, the surface treatment method of the present invention in which an after-treatment is performed using a specified treatment agent (Examples 1~23) makes it possible to obtain an improving effect in both the light resistance and gas resistance of recorded matter. On the other hand, in cases where no after-treatment is performed (Comparative Example 1), it is seen that the effect on the gas resistance of magenta images and cyan images in particular (and especially the effect on the gas resistance of cyan images) is inferior, so that sufficiently satisfactory weather resistance cannot be obtained.

Example 24

Printed matter samples A and B respectively obtained by the manufacturing methods for printed matter A and B described below were respective immersed for 5 seconds in the treatment liquid obtained in Example of Manufacture 1 described below, and were then drawn out of the treatment liquid and dried with a household drier, thus producing treated printed matter samples A1 and B1 (both with a water content of 8 wt %). The coating amount in each case was 5 to 7 g/m$^2$.

(Manufacturing Method for Printed Matter A)

A commercially marketed ink jet recording medium (commercial name "PM photographic paper", manufactured by EPSON Co.) was used as a recording medium with an ink receiving layer formed on a water-resistant base material. Color patches were printed on this recording medium by means of an ink jet printer (commercial name "PM800C", manufactured by Seiko-Epson K.K.) using dye inks (100% patches of four colors C, M, Y and Bk), thus producing printed matter A.

(Manufacturing Method for Printed Matter B)

High-definition color digital standard images ((ISO/JIS-SCID), image name: "portrait" (sample No. 1, image evaluation recognition No. N1)) were printed on the same recording medium as that used in the aforementioned manufacturing method for printed matter A by means of the aforementioned PM800C using the same dye inks as those used in the aforementioned manufacturing method for printed matter A, thus producing printed matter B.

Examples 25 and 26, and Comparative Examples 2~8

Respective printed matter samples A2, A3, B2 and B3, and comparative treated printed matter samples A'1 A'7 and B'1 B'7 were obtained in the same manner as in Example 24, except that the treatment liquids respective obtained in Examples of Manufacture 2 and 3 described below and Comparative Examples of Manufacture 1 through 7 described below were used instead of the abovementioned treatment liquid used in Example 24.

Example of Manufacture 1

10 parts of an ethylene-polyvinyl alcohol copolymer used as a water-soluble resin (commercial name "Soanol", manufactured by Nippon Gosei Kagaku Kogyo K.K.), 3 parts of a water-soluble ultraviolet absorbing agent (commercial name "Nidral", manufactured by Taki Kagaku K.K.), and 0.1 parts of an ink fixing agent (commercial name "Polyfix 601", manufactured by Showa Kobunshi K.K.) were added to 86.9 parts of an aqueous solution (ethanol content: 30 parts), and these constituents were mixed to produce a treatment liquid with a solid content of 13.1% and a viscosity of 20 cps.

Example of Manufacture 2

10 parts of a polyvinylidene chloride used as a water-soluble resin (commercial name "Kurehalon Latex", manufactured by Kureha Kagaku K.K.), 3 parts of a water-soluble HALS used as a light resistance improving agent (commercial name "AFG01", manufactured by Senka K.K.) and 0.1 parts of a diallyldimethylammonium chloride polymer used as an ink fixing agent (commercial name "PAS-H", manufactured by Nitto Boseki K.K.) were added to 86.9 parts of water, and these constituents were mixed to produce a treatment liquid with a solid concentration of 13.1% and a viscosity of 21 cps.

Example of Manufacture 3

3 parts of a polyvinyl alcohol used as a water-soluble resin (commercial name "PVA210", manufactured by Kurare K.K.), 3 parts of a water-soluble ultraviolet absorbing agent (commercial name "Nidral", manufactured by Taki Kagaku K.K.), and 0.1 parts of a diallyldimethylammonium chloride polymer used as an ink fixing agent (commercial name "PAS-H", manufactured by Nitto Boseki K.K.) were added to 93.9 parts of water, and these constituents were mixed to produce a treatment liquid with a solid concentration of 6.1% and a viscosity of 15 cps.

Comparative Example of Manufacture 1

A treatment liquid with a solid concentration of 13% and a viscosity of 11 cps was obtained in the same manner as in Example of Manufacture 1, except that water was used instead of the ink fixing agent used in Example of Manufacture 1.

Comparative Example of Manufacture 2

A treatment liquid with a solid concentration of 13% and a viscosity of 10 cps was obtained in the same manner as in Example of Manufacture 2, except that water was used instead of the ink fixing agent used in Example of Manufacture 2.

Comparative Example of Manufacture 3

A treatment liquid with a solid concentration of 6% and a viscosity of 12 cps was obtained in the same manner as in Example of Manufacture 3, except that water was used instead of the ink fixing agent used in Example of Manufacture 3.

Comparative Example of Manufacture 4

A treatment liquid with a solid concentration of 10.1% and a viscosity of 11 cps was obtained in the same manner as in Example of Manufacture 1, except that water was used instead of the light resistance improving agent used in Example of Manufacture 1.

Comparative Example of Manufacture 5

A treatment liquid with a solid concentration of 0.1% and a viscosity of 15 cps was obtained in the same manner as in Example of Manufacture 1, except that water was used instead of the water-soluble resin, light resistance improving agent and ethanol used in Example of Manufacture 1.

Comparative Example of Manufacture 6

A treatment liquid with a solid concentration of 3.1,% and a viscosity of 11 cps was obtained in the same manner as in Example of Manufacture 1, except that water was used instead of the water-soluble resin used in Example of Manufacture 1.

Comparative Example of Manufacture 7

A treatment liquid with a solid concentration of 13% and a viscosity of 10 cps was obtained in the same manner as in Example of Manufacture 1, except that starch (commercial name "MS3800", manufactured by Nippon Shokuhin Kako K.K.) was used instead of the water-soluble resin (ethylene-polyvinyl alcohol copolymer) used in Example of Manufacture 1.

(Evaluation of Treatment Characteristics, Gas Resistance, Change in Image Quality, Water Resistance, Moisture Resistance and Light Resistance)

Treated printed matter samples A1 through A3 respective obtained in Examples 24 through 26, and comparative treated printed matter samples A'1 through A'7 respectively obtained in Comparative Examples 2 through 8 were evaluated according to the (Evaluation Criteria for Treatment Characteristics), (Evaluation Criteria for Gas Resistance) and (Evaluation Criteria for Changes in Image Quality) described below. The results obtained are shown in Table 2 below. Furthermore, the (Evaluation of Water Resistance) and (Evaluation of Moisture Resistance) were performed only for treated printed matter samples A1 through A3 and comparative treated printed matter samples A'4 through A'7, and these samples were evaluated according to the (Evaluation Criteria for Water Resistance) and (Evaluation Criteria for Moisture Resistance) described below.

Furthermore, treated printed matter samples B1 through B3 respectively obtained in Examples 24 through 26, and comparative treated printed matter samples B'1 through B'7 respectively obtained in Comparative Examples 2 through 8 were evaluated according to the (Evaluation Criteria for Light Resistance) shown below. The results obtained are shown in Table 2 below.

(Evaluation Criteria for Treatment Characteristics)

The "surface conditions" and "degree of running of the dye" shown by the treated printer matter samples A1 through A3 and comparative treated printed matter samples A'1 through A'7 were observed visually, and were evaluated according to the respective evaluation criteria shown below.

(Evaluation Criteria for Surface Conditions)

O: Good surface conditions unchanged from conditions before treatment.

Δ: Considerable running and irregularities remain; at limit of practical use.

X: Extensive running and irregularities; not suitable for practical use.

(Evaluation Criteria for Running of Dye)

O: Absolutely no running observed.

X: Running of at least one color among C, M, Y and Bk can be observed.

(Evaluation Criteria for Gas Resistance)

The treated printed matter samples A1 through A3 and comparative treated printed matter samples A'1 through A'7 were respectively placed in glass containers equipped with a gas introduction port and discharge port, and a gas treatment was performed by continuously introducing (for 30 minutes) a mixed gas (ozone 1 ppm, $NO_x$ 1 ppm, $So_2$ 1 ppm) generated by a gas generator. Following this gas treatment, the respective color differences (mean values for the three colors C, M and Y) relative to the respective treated printed matter samples and comparative treated printed matter samples prior to the gas treatment were measured for the respective treated printed matter samples and comparative treated printed matter samples using a color difference meter, and these samples were evaluated according to the following evaluation criteria:

(Evaluation Criteria)

O: Color difference less than 5. Gas resistance good.

Δ: Color difference 5 or greater but less than 15. At limit of practical use.

X: Color difference 15 or greater. Not suitable for practical use.

(Evaluation Criteria for Change in Image Quality)

The reflective density was measured using a reflective density measuring device ("SPM50-1" manufactured by Gretag-MacBeth Co.) for the printed matter sample A (before treatment), the treated printed matter samples A1 through A3 and the comparative treated printed matter samples A'1 through A'7. The OD variation rate (mean values for the three colors C, M and Y) was determined, and the samples were evaluated according to the following evaluation criteria:

(Evaluation Criteria)

O: OD variation rate 5% or less.

Δ: OD variation rate less than 10%.

X: OD variation rate 10% or greater.

(Evaluation Criteria for Water Resistance)

The treated printed matter samples A1 through A3 and comparative treated printed matter samples A'4 through A'7 were allowed to stand for 24 hours at a temperature of 25° C. and a relative humidity of 50%; afterward, 0.3 cc of water droplets was dropped onto areas that were 100% patches of C, M, Y and Bk, and the samples were allowed to stand for another 24 hours at a temperature of 25° C. and a relative humidity of 50%. Afterward, the "degree of running of the dye" was observed visually for the treated printed matter samples A1 through A3 and comparative treated printed matter samples A'4 through A'7, and these samples were evaluated according to the following evaluation criteria:

(Evaluation Criteria)

O: Absolutely no running observed. Good water resistance.

Δ: Running of two colors among C, M, Y and Bk can be observed. At limit of practical use.

X: Running of three or more colors among C, M, Y and Bk can be observed. Not suitable for practical use.

(Evaluation Criteria for Moisture Resistance)

The treated printed matter samples A1 through A3 and comparative treated printed matter samples A'4 through A'7 were subjected to a drying treatment by being allowed to stand for 24 hours at a temperature of 25° C. and a relative humidity of 50%. Afterward, a wetting treatment was performed by allowing the samples to stand for 24 hours at a temperature of 40° C. and a relative humidity of 80%. For image background areas on the respective treated printed matter samples and comparative treated printed matter samples following the wetting treatment, the color differences (mean values for the three colors C, M and Y) relative to the respective treated printed matter samples and comparative treated printed matter samples prior to the wetting treatment (but after the drying treatment) were determined using a color difference meter, and these samples were evaluated according to the following evaluation criteria:

(Evaluation Criteria)

O: Color difference less than 5. Moisture resistance good.

Δ: Color difference 5 or greater but less than 10. At limit of practical use.

X: Color difference 10 or greater. Not suitable for practical use.

(Evaluation Criteria for Light Resistance)

The treated printed matter samples B1 through B3 and the comparative treated printed matter samples B'1 through B'7 were respectively subjected to a 45 $kJ/m^2$ exposure treatment at a radiant energy of 0.25 $W/m^2$ (340 nm), a black panel temperature of 63° C. and a relative humidity of 50% using a xenon weather-o-meter Ci35a (manufactured by ATLAS Co.). For image background areas on the respective treated printed matter samples and comparative treated printed matter samples following the exposure treatment, the color differences (mean values for the three colors C, M and Y) relative to the respective treated printed matter samples and comparative treated printed matter samples prior to the exposure treatment were determined using a color difference meter, and these samples were evaluated according to the following evaluation criteria:

(Evaluation Criteria)

O: Color difference less than 5. Moisture resistance good.

Δ: Color difference 5 or greater but less than 10. At limit of practical use.

X: Color difference 10 or greater. Not suitable for practical use.

(Measurement of Oxygen Permeability)

The oxygen permeability of the treated printed matter samples A1 through A3 and comparative treated printed matter samples A'1 through A'7 at a temperature of 20° C. and a relative humidity of 90% was measured according to the aforementioned ASTM-D1434. The results obtained are shown in Table 2 below.

TABLE 2

| | Evaluation | | | | | | | |
|---|---|---|---|---|---|---|---|---|
| | Treatment characteristics | | Change in | | | | | Oxygen permeability |
| | Surface conditions | Degree of running of dye | Gas resistance | image quality | Water resistance | Moisture resistance | Light resistance | (cc/m2 × D × atm) |
| Example | | | | | | | | |
| 24 | ○ | ○ | ○ | ○ | ○ | ○ | ○ | 6.1 |
| 25 | ○ | ○ | ○ | ○ | ○ | ○ | ○ | 7.1 |
| 26 | ○ | ○ | ○ | ○ | ○ | ○ | ○ | 7.6 |
| Comparative Example | | | | | | | | |
| 2 | × | × | Δ | Δ | — | — | ○ | 8.2 |
| 3 | × | × | Δ | Δ | — | — | ○ | 7.3 |
| 4 | × | × | Δ | Δ | — | — | Δ | 9.8 |
| 5 | ○ | ○ | ○ | ○ | ○ | ○ | Δ | 6.1 |
| 6 | ○ | ○ | × | Δ | ○ | ○ | Δ | ∞ |
| 7 | ○ | ○ | × | Δ | ○ | Δ | Δ | ∞ |
| 8 | ○ | ○ | × | Δ | Δ | Δ | Δ | 6500 |

Evaluations of the "treatment characteristics", "gas resistance", "change in image quality", "water resistance" and "moisture resistance" and measurement of the "oxygen permeability" were performed for the treated printed matter samples A1 through A3 (Examples 24 through 26) and comparative treated printed matter samples A'1 through A'7 (Comparative Examples 2 through 8; however, the "water resistance" and "moisture resistance" were evaluated only for Comparative Examples 5 through 8). An evaluation of the "light resistance" was performed for the treated printed matter samples B1 through B3 (Examples 24 through 26) and comparative treated printed matter samples B'1 through B'7 (Comparative Examples 2 through 8).

As is clear from the results shown in Table 2, printed matter samples treated with treatment liquids (Examples of Manufacture 1 through 3) according to the surface treatment methods for printed matter described in Examples 24 through 26 are all superior in terms of treatment characteristics, gas resistance, changes in image quality, water resistance, moisture resistance, light resistance and oxygen permeability. On the other hand, it is seen that printed matter samples treated with treatment liquids (Comparative Examples of Manufacture 1 through 7) according to the surface treatment methods for printed matter described in Comparative Examples 2 through 8 all fall short of reaching satisfactory levels in terms of treatment characteristics, gas resistance, changes in image quality, water resistance, moisture resistance, light resistance and oxygen permeability. Furthermore, in the surface treatment methods for printed matter described in Examples 24 through 26, the printed matter was impregnated with the treatment liquid by immersing the printed matter in the treatment liquid; however, the same results were obtained when the printed matter was impregnated with the treatment liquid by "spraying the treatment liquid by means of a sprayer" instead of "immersion in the treatment liquid".

Example 27

Recorded matter for evaluation (beta printing of Y (yellow), M (magenta) and C (cyan) with an optical density of 1.0) consisting of color patches, portrait images and the like was formed on an ink jet recording medium (PM photographic paper manufactured by Seiko-Epson K.K., void ratio of ink receiving layer measured using JAPAN TAPPI No. 48-85: approximately 65%) using a commercially marketed ink jet printer (PM-800C manufactured by Seiko-Epson K.K.). The recorded matter immediately following recording showed good images in all cases. The surface of this recorded matter was subjected to a spray treatment using Bosco Extra Virgin Olive Oil (manufactured by Nisshin Seiyu K.K.), thus producing recorded matter with a protected surface.

Comparative Example 9

Recorded matter obtained in the same manner as in the [above] examples was not subjected to any after-treatment; this recorded matter was evaluated "as is" without any surface treatment.

(Gas Resistance Test)

Using a simple $O_3$ gas generator, the respective recorded matter samples were exposed for 10 hours to approximately 5 ppm of $O_3$ gas. Next, the residual percentage (%) of the optical density following the exposure test was determined by measuring the optical density of the recorded matter before and after the exposure test using a spectrophotometer (GRETAG SPM50 manufactured by Gretag-MacBeth Co.).

(Luster Test)

In regard to luster, the 75-degree mirror surface luster was measured using a luster meter.

In the [above] example, the residual percentage of the optical density exceed 90%, so that the gas resistance was good, and the 75-degree mirror surface luster was 70 to 75, so that the luster was also good. On the other hand, in the [above] comparative example, the residual percentage of the optical density was less than 70%, so that the gas resistance was inferior to that of the example, and the 75-degree mirror surface luster was 40 to 45, so that the luster was also inferior to that of the example.

In addition to using the abovementioned olive oil, similar evaluations were also performed using Econa (manufactured by Kao K.K.), corn oil (manufactured by Ajinomoto K.K.), canola oil (manufactured by Nisshin Seiyu K.K.), salad oil (manufactured by Toyotoshi K.K.), Nisshin Tempura Meijin (manufactured by Nisshin Seiyu K.K.) and Olein Rich (manufactured by Showa Sangyo K.K.). The results obtained were similar to those obtained in the case of olive oil.

Examples 28~31

The surfaces of recorded matter samples were treated by the treatment methods shown in Table 3 using the surface treatment agents shown in Table 3 in the same manner as in the abovementioned Example 27, thus producing surface-treated recorded matter samples.

Comparative Example 10

Recorded matter obtained in the same manner as in Example 28 was not subjected to an after-treatment, and this recorded matter was evaluated "as is" without any surface treatment. A gas resistance test was performed in the same manner as in the abovementioned Example 27.

(Indoor Exposure Test)

The respective recorded matter samples were exposed indoors for three months. Next, the optical density was measured in the same manner as in the case of the abovementioned gas resistance test, and an evaluation was performed using similar evaluation criteria.

(Water Resistance Test)

The respective recorded matter samples were immersed in tap water for 5 minutes, and running was observed according to the following evaluation criteria:

A: Absolutely no running seen.

B: Slight running seen.

(Moisture Resistance Test)

The respective recorded matter samples were allowed to stand for one week at a temperature of 40° C. and a relative humidity of 85%. Next, running was observed according to the following evaluation criteria:

A: Absolutely no running seen.

B: Slight running seen.

(Plasticizer Resistance Test)

The respective recorded matter samples were allowed to stand for four weeks at a temperature of 60° C. with cellophane tape applied to the samples. Next, an evaluation was performed according to the following evaluation criteria:

A: No yellowing.

B: Yellowing seen.

(Light Resistance Test)

A 90 kJ/m$^2$ exposure test was performed at a black panel temperature of 35° C., a relative humidity of 60% and an ultraviolet irradiation intensity of 0.18 W/m$^2$ (340 nm) using a xenon fade-o-meter (manufactured by ATLAS Co.). Next, the optical density was measured in the same manner as in the case of the abovementioned gas resistance test, and an evaluation was performed using similar evaluation criteria.

(Test of Resistance to Thermal Yellowing)

The respective recorded matter samples were allowed to stand for two weeks at a temperature of 80° C. Next, an evaluation was performed according to the following evaluation criteria:

A: No yellowing seen.

B: Yellowing seen.

(Luster Test)

In regard to luster, the 75-degree mirror surface luster was measured using a luster meter.

TABLE 3

| Surface treatment agent | Treatment method | Gas resistance | Indoor exposure test | Water resistance | Moisture resistance | Plasticizer resistance | Light resistance | Resistance to thermal yellowing | 75-degree mirror surface luster |
|---|---|---|---|---|---|---|---|---|---|
| Example 28 | | | | | | | | | |
| Liquid paraffin (viscosity approximately 25 cst) only (100) | Spray treatment | A | B | A | A | A | B | A | 70–75 |
| | Coating treatment | A | B | A | A | A | B | A | 75–80 |
| Example 29 | | | | | | | | | |
| Liquid paraffin (99) + tocopherol (1) | Spray treatment | A | A | A | A | A | A | A | 70–75 |
| | Coating treatmeat | A | A | A | A | A | A | A | 75–80 |
| Example 30 | | | | | | | | | |
| Liquid paraffin (95) + benzotriazole type UVA TINUVIN 327 (Ciba-Geigy) (5) | Spray treatment | A | A | A | A | A | A | A | 70–75 |
| | Coating treatment | A | A | A | A | A | A | A | 75–80 |

TABLE 3-continued

| Surface treatment agent | Treatment method | Gas resistance | Indoor exposure test | Water resistance | Moisture resistance | Plasticizer resistance | Light resistance | Resistance to thermal yellowing | 75-degree mirror surface luster |
|---|---|---|---|---|---|---|---|---|---|
| Example 31 | | | | | | | | | |
| Liquid paraffin (95) + hindered amine type compound TINUVIN 622LD (Ciba-Geigy) (5) | Spray treatment | A | A | A | A | A | A | A | 70–75 |
| | Coating treatment | A | A | A | A | A | A | A | 75–80 |
| Comparative Example 10 | | | | | | | | | |
| — | None (untreated) | D | C | B | B | B | C | A | 40–45 |

(note)
The composition ratios (wt %) are shown aa numerals in parentheses following the materials in the table.

As is clear from the results shown in Table 3, the surface treatment method of the present invention makes it possible to obtain recorded matter which is superior in terms of gas resistance, resistance to indoor exposure, water resistance, moisture resistance, plasticizer resistance, light resistance, resistance to thermal yellowing, and luster. On the other hand, in the case of Comparative Example 10, the gas resistance, resistance to indoor exposure, water resistance, moisture resistance, plasticizer resistance, light resistance and luster are inferior to the values obtained in Examples 28 through 31.

INDUSTRIAL APPLICABILITY

The surface treatment method and surface treatment apparatus of the present invention make it possible to improve the weather resistance characteristics such as the light resistance, gas resistance, water resistance, moisture resistance, resistance to thermal yellowing, plasticizer resistance and changes in image quality of recorded matter, and also make it possible to improve the luster, treatment characteristics, oxygen permeability and friction resistance of such recorded matter.

Specifically, the surface treatment method and surface treatment apparatus for printed matter provided by the present invention make it possible to prevent the deterioration of printed matter, and especially to improve the weather resistance characteristics such as the light resistance and gas resistance of printed matter, so that discoloration and fading of this printed matter caused by ultraviolet light, visible light and oxidizing gases can be prevented, while causing hardly any change in image quality. Furthermore, a surface treatment of printed matter can easily be performed in a general household without using any special apparatus.

The surface-treated product of the present invention shows improved weather resistance characteristics of the recorded matter, and especially improved gas resistance and light resistance.

The present invention makes it possible to apply an appropriate treatment agent as a coating in accordance with the type of recording medium used, so that the recorded surface can be endowed with a desired light resistance, gas resistance, water resistance and friction resistance, and so that this recorded surface can be endowed with luster or finished to a matte finish.

The invention claimed is:

1. A surface treatment method comprising (a) providing recorded matter comprising an ink jet recording medium in which at least a cyan image is recorded with particles of ink jetted from a nozzle of an ink jet recording apparatus, and (b) treating a surface of the recorded matter in which the cyan image is recorded with a treatment agent for forming a protective layer on the recorded matter, said treatment agent comprising at least one sulfur compound selected from the group consisting of, a thio ether compound, a sulfur halide, sulfur oxyhalide, a halogenosulfonic acid and a derivative of these compounds.

2. The surface treatment method according to claim 1, wherein said treatment agent contains, in addition to the at least one sulfur compound, at least one other compound selected from the group consisting of a nitrogen compound, a fluorine compound, a natural resin and a synthetic resin.

3. The surface treatment method according to claim 1, wherein said recording medium is a recording medium in which an ink receiving layer is disposed on a support.

4. The surface treatment method according to claim 1, wherein said treatment is a spray treatment, blowing treatment, coating treatment, immersion treatment or treatment using an ink jet recording head.

5. The surface treatment method according to claim 1, wherein the at least one sulfur compound is present in the treatment agent in an amount effective to improve both a light resistance and a gas resistance of the recorded matter treated with the treatment agent in step (b) as compared with recorded matter which has not been so treated.

6. The surface treatment method according to claim 1, wherein the treatment agent is applied to the surface of the recorded matter in an amount of 0.1 to 10 g/m$^2$ and forms an overcoat layer thereon.

7. An ink jet recording method comprising (a) jetting particles of at least cyan ink onto the surface of a recording medium to form recorded matter comprising the recording medium with at least a cyan image recorded thereon with the particles of the cyan ink, and (b) forming a protective layer on the recorded matter to protect at least the cyan image by treating a surface of the recorded matter in which the cyan image is recorded with a treatment agent comprising at least one sulfur compound selected from the group consisting of a thio ether compound, a sulfur halide, sulfur oxyhalide, a halegenosulfonic acid and a derivative of these compounds, wherein the at least one sulfur compound is present in the treatment agent in an amount effective to improve both a light resistance and a gas resistance of the recorded matter treated with the treatment agent in step (b) as compared with recorded matter which has not been so treated.

8. The surface treatment method according to claim 7, wherein the treatment agent is applied to the surface of the recorded matter in an amount of 0.01 to 30 g/m$^2$.

* * * * *